US010775738B2

(12) United States Patent
Mogi

(10) Patent No.: US 10,775,738 B2
(45) Date of Patent: Sep. 15, 2020

(54) AIR BLOWING COOLING MECHANISM, IMAGE HEATING APPARATUS AND IMAGE FORMING APPARATUS

(71) Applicant: CANON KABUSHIKI KAISHA, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/400,408

(22) Filed: May 1, 2019

(65) Prior Publication Data

US 2019/0339644 A1 Nov. 7, 2019

(30) Foreign Application Priority Data

May 2, 2018 (JP) ..... 2018-088694

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 15/2064* (2013.01); *G03G 15/2046* (2013.01); *G03G 2221/1645* (2013.01); *G03G 2221/1657* (2013.01)

(58) Field of Classification Search
CPC ..... G03G 21/206; G03G 15/2064; G03G 15/2017; G03G 15/2046; G03G 15/2042; G03G 2221/1645; G03G 2221/1657; E06B 2007/023; E06B 3/924
See application file for complete search history.

(56) References Cited

U.S. PATENT DOCUMENTS 6,059,243 A * 5/2000 Hikage ..... B60N 3/102 248/311.2
8,725,025 B2 * 5/2014 Murasaki ..... G03G 15/2017 399/92
2014/0112680 A1 4/2014 Ueno et al.
2015/0241824 A1 8/2015 Sekiya
2019/0155195 A1 * 5/2019 Hasegawa ..... G03G 15/2017

FOREIGN PATENT DOCUMENTS

JP 2014-102486 A 6/2014
JP 2015-158600 A 9/2015

OTHER PUBLICATIONS

Copending, unpublished U.S. Appl. No. 16/400,440 to Keisuke Mogi, filed May 1, 2019.

* cited by examiner

*Primary Examiner* — Arlene Heredia
(74) *Attorney, Agent, or Firm* — Venable LLP

(57) ABSTRACT

An air blowing cooling mechanism includes a duct, a fan, a first shutter member, a second shutter member, a first drive transmitting portion for transmitting a driving force to the second shutter member, and a second drive transmitting portion for transmitting the driving force from the second shutter member to the first shutter member. The second shutter member is supported by the duct so as to be slidable relative to the duct. The first shutter member is supported by the second shutter member so as to be slidable relative to the second shutter member. The second shutter member includes a slidable portion slidable relative to the first shutter member when said first shutter member slides.

12 Claims, 18 Drawing Sheets

(a) FULL-CLOSE STATE (b) FULL-OPEN STATE (a)FULL-CLOSE STATE (b)FULL-OPEN MOVEMENT (a)FULL-CLOSE STATE (b)FULL-OPEN MOVEMENT

AIR BLOWING COOLING MECHANISM, IMAGE HEATING APPARATUS AND IMAGE FORMING APPARATUS

FIELD OF THE INVENTION AND RELATED ART

The present invention relates to an air blowing cooling mechanism for use with an image heating apparatus, and relates to the image heating apparatus and an image forming apparatus. This image heating apparatus is, for example, capable of being used as a fixing device for heat-fixing a toner image formed on a recording material. The image forming apparatus includes, for example, a copying machine, a printer, a facsimile machine or a multi-function machine having a plurality of functions of these machines, using an electrophotographic type.

For example, in an electrophotographic image forming apparatus, an unfixed toner image is formed on a sheet-like recording material (sheet) or paper by an image forming means, and thereafter, is fixed as a fixed image by a fixing means.

As a type of the fixing means, various types have been proposed, but a fixing device of a heat and pressure type in which the toner image is fixed under application of heat and pressure has been used in general. This fixing device includes a rotatable heating member (fixing roller, fixing film or the like) to be heated by a heating means and a rotatable pressing member (pressing roller, pressing belt or the like) for forming a fixing nip in press-contact with the rotatable heating member. Then, both the rotatable members are rotated, and a sheet on which the unfixed toner image is carried is guided into the fixing nip and is nipped and fed through the fixing nip, so that the toner image is fixed on a surface of the sheet by the heat of the rotatable heating member and nip pressure.

In such a fixing device, a surface temperature excessively increases in a non-sheet-passing region (non-contact region with the sheet) of the rotatable heating member when small-size sheets (smaller in width than maximum-size sheets which can be passed through the fixing device and which have a maximum width) are continuously passed through the fixing device and thus fixing is carried out.

Here, the non-sheet-passing region (non-sheet-passing portion) is a region of the rotatable heating member which does not contact the small-size sheets when the small-size sheets are passed through the fixing device. This is because when the small-size sheets are continuously passed through the fixing device, in the non-sheet-passing region through which the sheets do not pass, heat is partly accumulated correspondingly to no heat extraction by the sheets. This phenomenon is called end portion temperature rise or non-sheet-passing portion temperature rise of the fixing device, and when this end portion temperature rise becomes an excessively high temperature level, it leads to an occurrence of hot offset and thermal deterioration of device constituent component parts.

As one of countermeasures against this non-sheet-passing portion temperature rise, a mechanism in which a cooling fan for cooling the non-sheet passing portion is provided has been known. Japanese Laid-Open Patent Application (JP-A) 2015-158600 discloses a constitution in which ducts for permitting blowing of air from cooling fans are provided at left and right sides of a fixing roller with respect to a longitudinal direction and in which shutters capable of opening and closing openings of the ducts are provided. In JP-A 2015-158600, each of the shutters is moved to a position depending on a width size of the sheet, and the air is blown by the cooling fan depending on a temperature detected by an element for detecting a temperature of a non-sheet-passing portion of the fixing roller. Thus, a cooling range is adjusted by moving the shutter, so that the non-sheet-passing portion temperature rise is suppressed.

Further, in JP-A 2015-158600, the shutters for adjusting a cooling range of the fixing roller by blocking air blowing by the cooling fan are disposed on one end (portion) side and the other end (portion) side (on left and right sides) with respect to a longitudinal direction (direction perpendicular to a sheet feeding direction) of the fixing roller. Each of shutter members constituting the shutters on one end side and the other end side is a single shutter member (shutter constitution with a single shutter (image) on each (one) side).

However, the shutter constitution of JP-A 2015-158600 has room for further improvement.

Specifically, in JP-A 2015-158600, the shutter members are moved by drive transmission from a pinion gear, provided at a longitudinal central portion of the fixing roller, to a rack provided on the shutter members. A size of each of shutter members disposed on one end side and the other end side, respectively, is such that the shutter member can shield at least an opening of the duct on the associated side, and at a close position, the opening of the duct is sufficiently closed by the shutter member. The shutter member moves from the close position toward the longitudinal central portion of the fixing roller, so that the shutter member opens and thus the air from the cooling fan is sent to the fixing roller.

In the case of such a constitution, the shutter members cannot open the openings up to a position where the shutter members disposed on one end side and the other end side contact each other or positions where each of the shutter members contacts an associated pinion gear.

On the other hand, in recent years, there is an increasing demand for printing on a smaller-size sheet (paper) such as an envelope or a postcard, so that it has been required to suppress the non-sheet-passing portion temperature rise even in the case where the small-size sheets are continuously passed through the fixing device.

Further, in the opening and closing operation of the shutters, the shutters may desirably move smoothly and it is understood that the shutters stop during the operation.

SUMMARY OF THE INVENTION

A principal object of the present invention is to provide an air blowing cooling mechanism apparatus capable of stably performing an operation of shutters while improving a cooling range of a rotatable heating member by fans.

According to an aspect of the present invention, there is provided an air blowing cooling mechanism for use with an image heating apparatus including a rotatable heating member for heating an image on a recording material in a nip. The air blowing cooling mechanism includes a duct provided with an air blowing port and a fan configured to blow air toward the air blowing port through the duct to cool a predetermined region of the rotatable heating member. The air blowing cooling mechanism also includes a first shutter member slidable so as to open and close the air blowing port and a second shutter member provided adjacent to the first shutter member and slidable so as to open and close the air blowing port in cooperation with the first shutter a member. A first drive transmitting portion is configured to transmit a driving force to the second shutter member in engagement with the second shutter member and a second drive transmitting portion is configured to transmit the driving force from the second shutter member to the first shutter member so that the first shutter member is slidable with a sliding operation of the second shutter member. The second shutter member is supported by the duct so as to be slidable relative to the duct, and the first shutter member is supported by the second shutter member so as to be slidable relative to the second shutter member. The second shutter member includes a slidable portion slidable relative to the first shutter member when the first shutter member slides.

Further features of the present invention will become apparent from the following description of exemplary embodiments with reference to the attached drawings.

BRIEF DESCRIPTION OF THE DRAWINGS

Parts (a) and (b) of FIG. 1 are schematic views showing a full-close state and a full-open state, respectively, of a shutter member structure with two shutters on each side.

Figure 15:
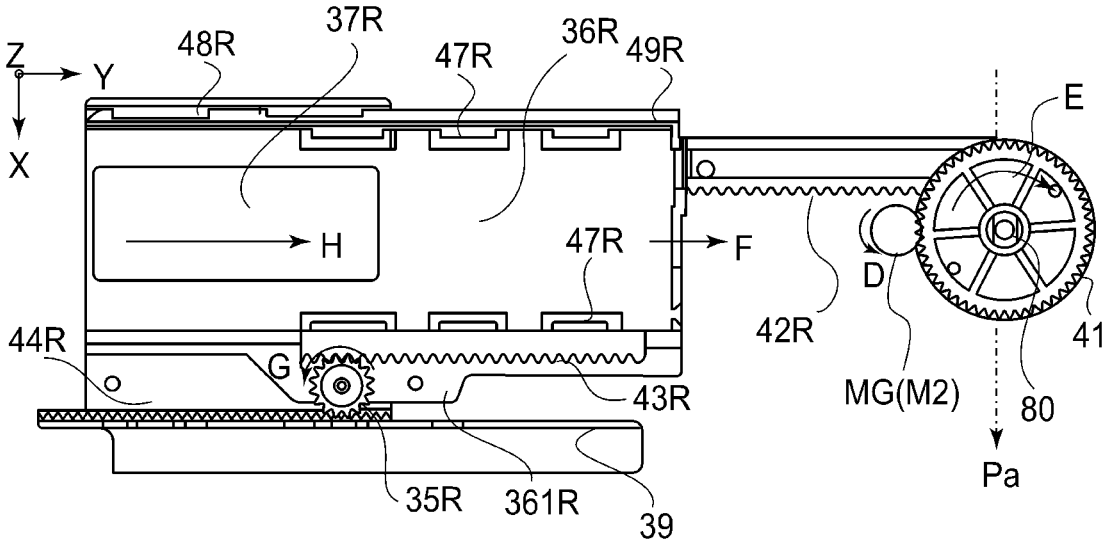
Figure 15:
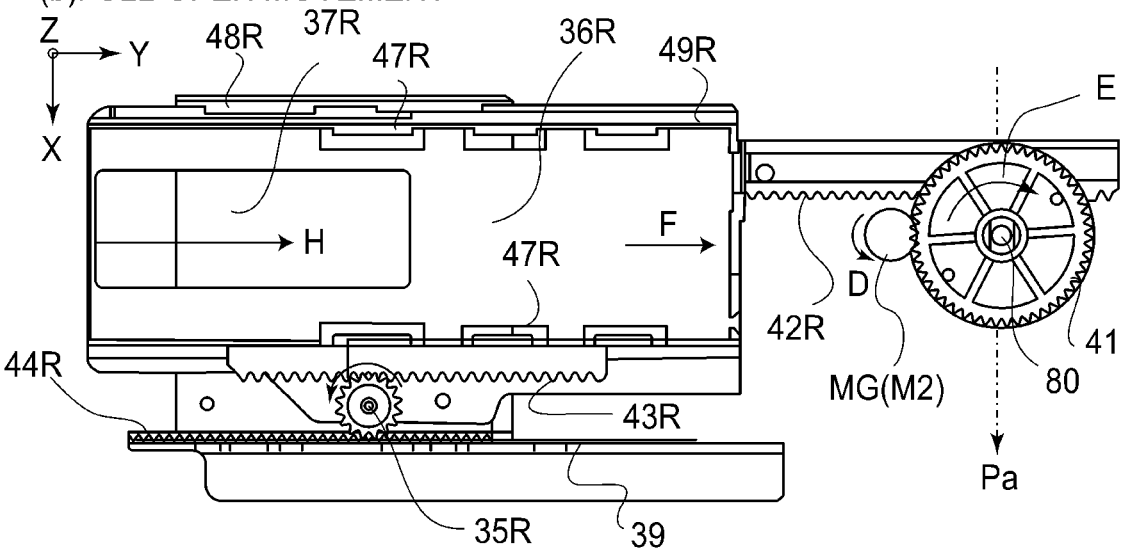

Parts (a) and (b) of FIG. 15 are schematic views of the shutter mechanism in an all close state and during an open movement operation, respectively, as seen from the inlet port side (an inside of the shutter mechanism).

Figure 16:
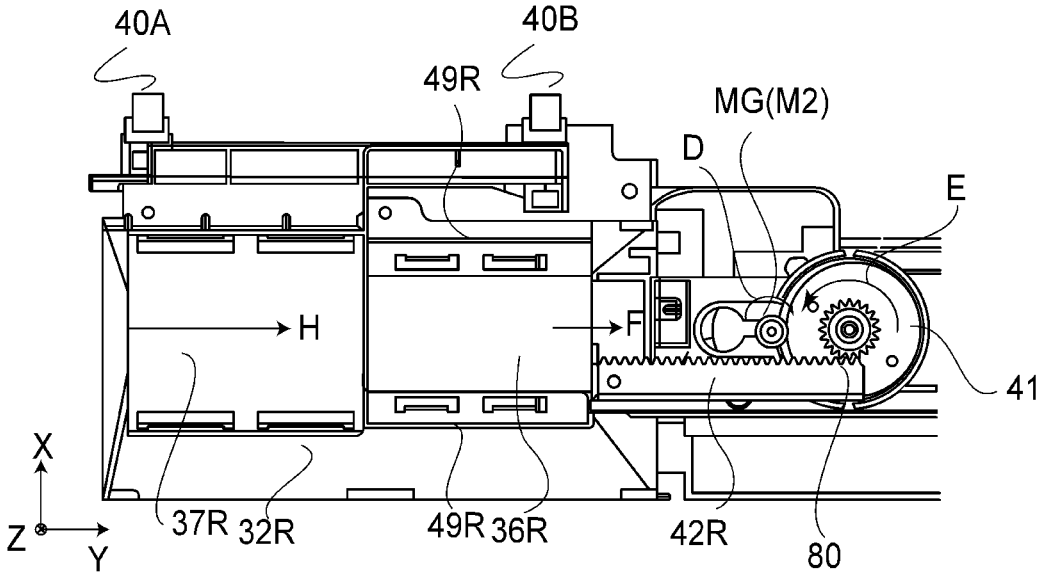
Figure 16:
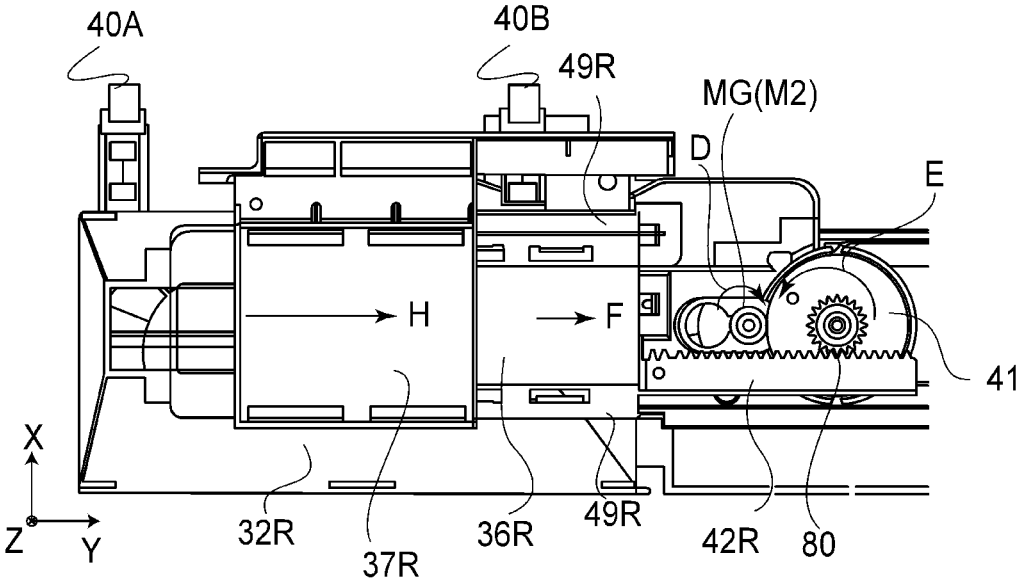

Parts (a) and (b) of FIG. 16 are schematic views of the shutter mechanism in the all close state and during the open movement operation, respectively, as seen from the air blowing port side (an outside of the shutter mechanism).

Figure 17:
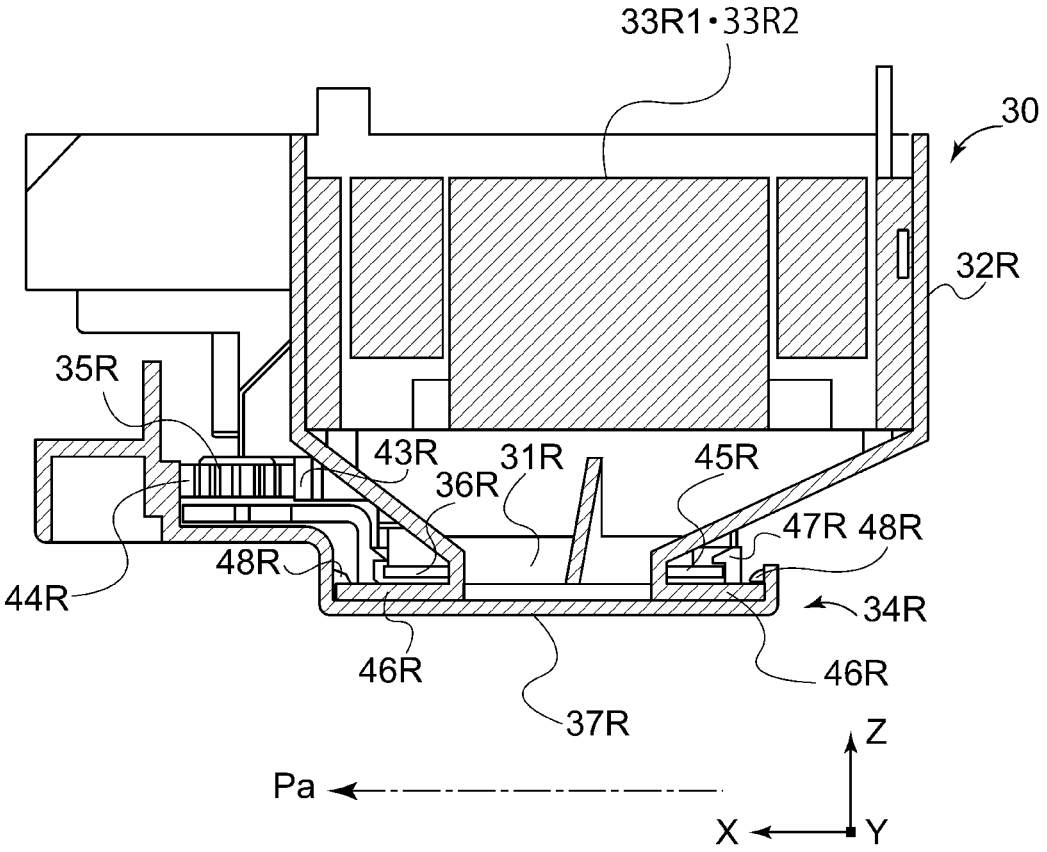

FIG. 17 is a schematic view showing a relationship among an inner shutter member, an outer shutter member and a duct.

Figure 18:
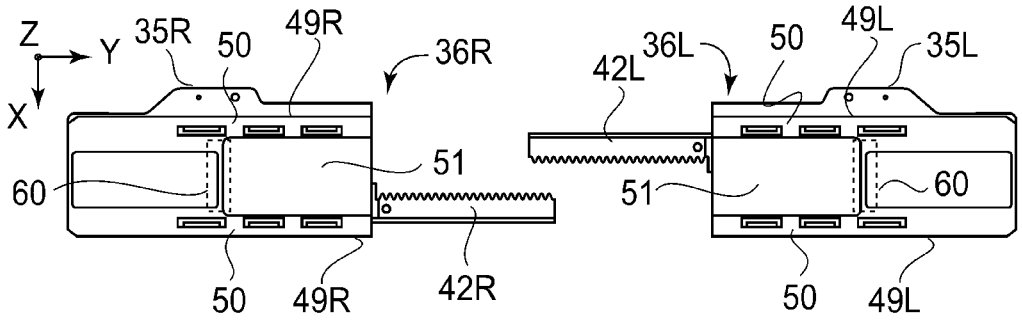

FIG. 18 is an outer surface view of the inner shutter member in the embodiment.

Figure 19:
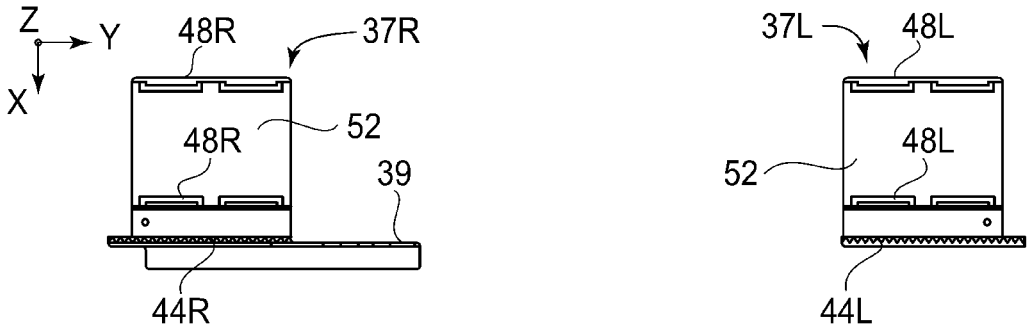

FIG. 19 is a schematic view for illustrating the outer shutter member in the embodiment.

DESCRIPTION OF EMBODIMENTS

Embodiments for carrying out the present invention will be specifically described with reference to the drawings. Dimensions, materials, shapes and relative arrangements of constituent elements described in the following embodiments should be appropriately be changed depending on structures and various conditions of mechanisms (apparatuses) to which the present invention is applied, and the scope of the present invention is not intended to be limited to the following embodiments.

Embodiment 1

(Image Forming Apparatus)

Figure 2:
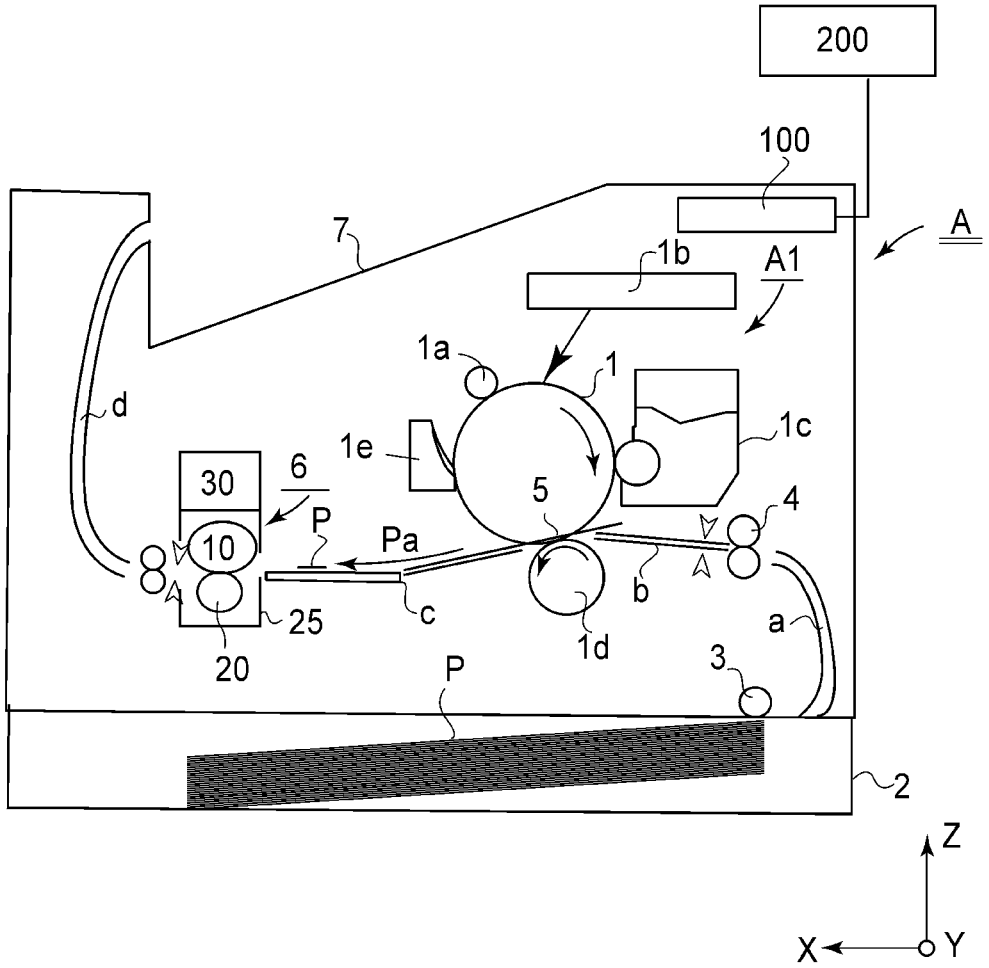
FIG. 2 is a schematic sectional view showing a general structure of an image forming apparatus in an embodiment.

FIG. 2 is a schematic sectional view showing a general structure of an example of an image forming apparatus A using electrophotography. In this embodiment, the image forming apparatus A is a monochromatic printer in which an image-formed product on which a toner image was formed by executing an image forming operation corresponding to a print job (image forming job) inputted from an external host device 200 such as a personal computer to a control circuit portion (CPU) 100 is printed out.

In the image forming apparatus A, an image forming portion A1 for forming the toner image on a recording material P (sheet or paper) includes a drum-type electrophotographic photosensitive member (drum) 1 as an image bearing member. The drum 1 is rotationally driven at a predetermined peripheral speed in the clockwise direction indicated by an arrow. Further, at a periphery of the drum 1 along a drum rotational direction, the image forming portion A1 includes, as process devices actable on the drum 1, a charging roller 1*a*, a laser scanner 1*b*, a developing device 1*c*, a transfer roller 1*d* and a cleaning device 1*e*. An electrophotographic process and an image forming operation of the image forming portion A1 are well known, and therefore will be omitted from description.

Incidentally, the recording material P is a sheet-shaped recording medium (media) on which the toner image is capable of being formed by the image forming apparatus. For convenience, treatment of the recording material (sheet) P will be described using sheet (paper)-related terms such as sheet passing, sheet feeding, sheet discharge, sheet passing portion and non-sheet-passing portion, but the recording material is not limited to paper.

One sheet P of sheets P accommodated in a sheet cassette 2 is separated and fed at predetermined control timing by rotation of a feeding roller 3. The sheet P passes through a path including a feeding path a, a registration roller pair 4 and a feeding path b and is introduced at predetermined control timing to a transfer portion (transfer nip) 5 which is a contact portion between the drum 1 and the transfer roller 1*d*. The sheet P is successively subjected to transfer of the toner image formed on the surface of the drum 1 during a process of being nipped and fed at the transfer portion 5.

The sheet P coming out of the transfer portion 5 is separated from the surface of the drum 1 and passes through a feeding path c and then is introduced into a fixing device (heating fixing device, image heating apparatus) 6 in which the toner image (image) formed on the sheet (recording material) P is fixed on the sheet S under application of heat and pressure. The sheet P coming out of the fixing device 6 passes through a feeding path d and is discharged as the image-formed product (resulting product) onto a discharge tray 7. In FIG. 2, an arrow Pa direction is a sheet feeding direction.

(Fixing Device)

Here, with respect to the fixing device 6, a front surface (side) is a surface (side) on an introduction side of the sheet P, a rear surface (side) is a surface (side) opposite from the front surface (side), and left and right are left (L) and right (R) as seen from the front side. A longitudinal direction is an axial direction or a generatrix direction of a rotatable member, and a short side direction is a direction perpendicular to the longitudinal direction. Up (upper) and down (lower) are up (upper) and down (lower) with respect to a direction of gravitation. These are also true for constituent members of the fixing device 6.

Further, an upstream side and a downstream side are an upstream side and a downstream side with respect to the sheet feeding direction Pa. One end side and the other end side are one end side and the other end side with respect to the longitudinal direction, and in this embodiment, a left side is one end side (non-driving side, front side), and a right side is the other end side (driving side (where a driving force is received), rear side). A width of the sheet P is a sheet dimension on a sheet surface with respect to a direction perpendicular to the sheet feeding direction Pa.

Figure 3:
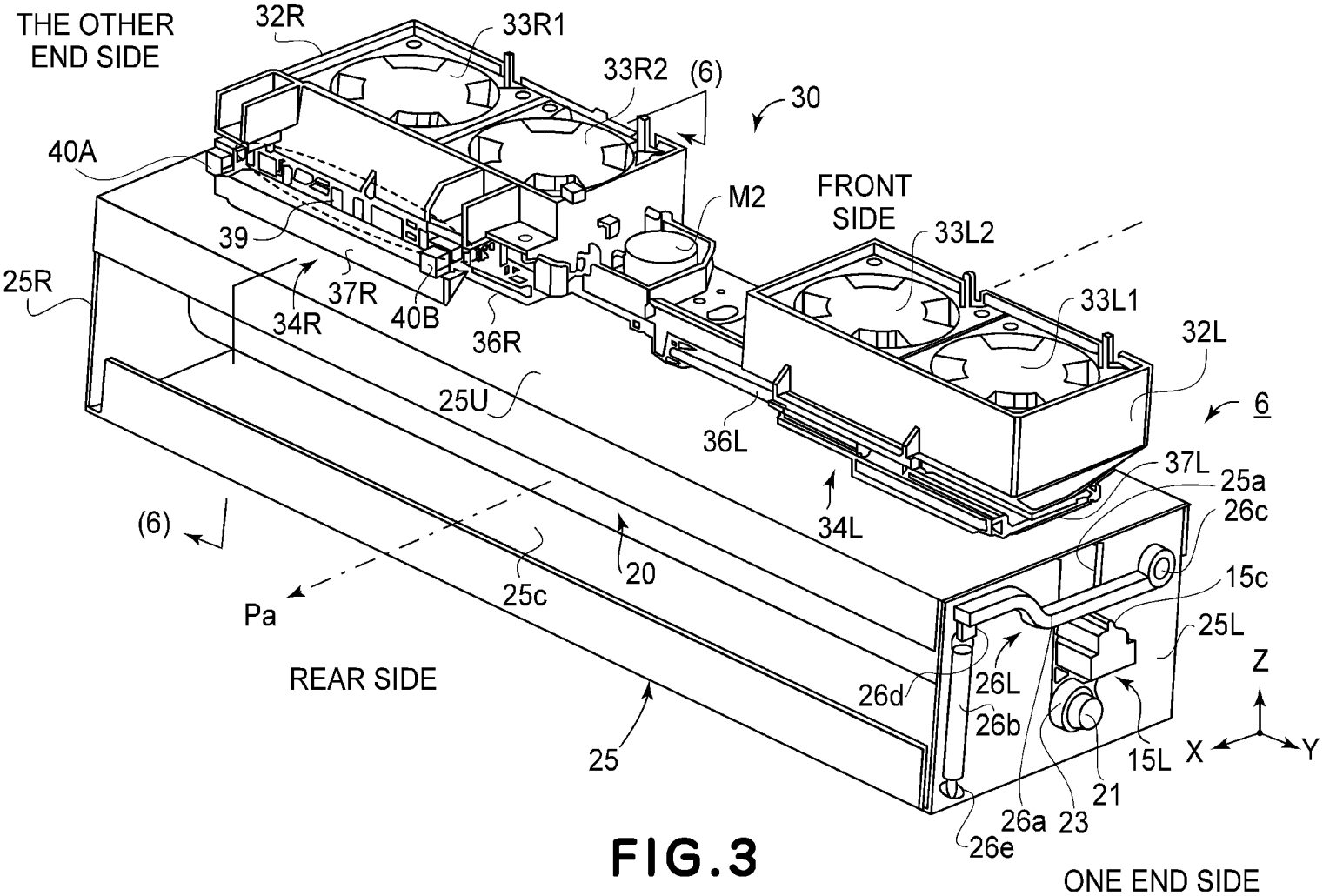
FIG. 3 is a schematic perspective view of an outer appearance of a fixing device on a rear side, one end side and an upper surface side.
Figure 4:
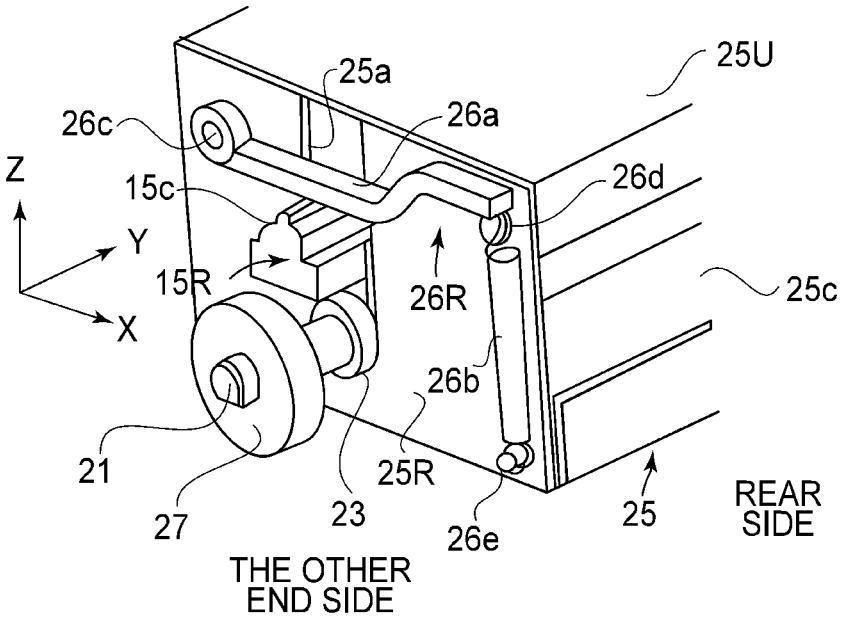
FIG. 4 is a schematic perspective view of an outer appearance of the fixing device on the other end side.
Figure 5:
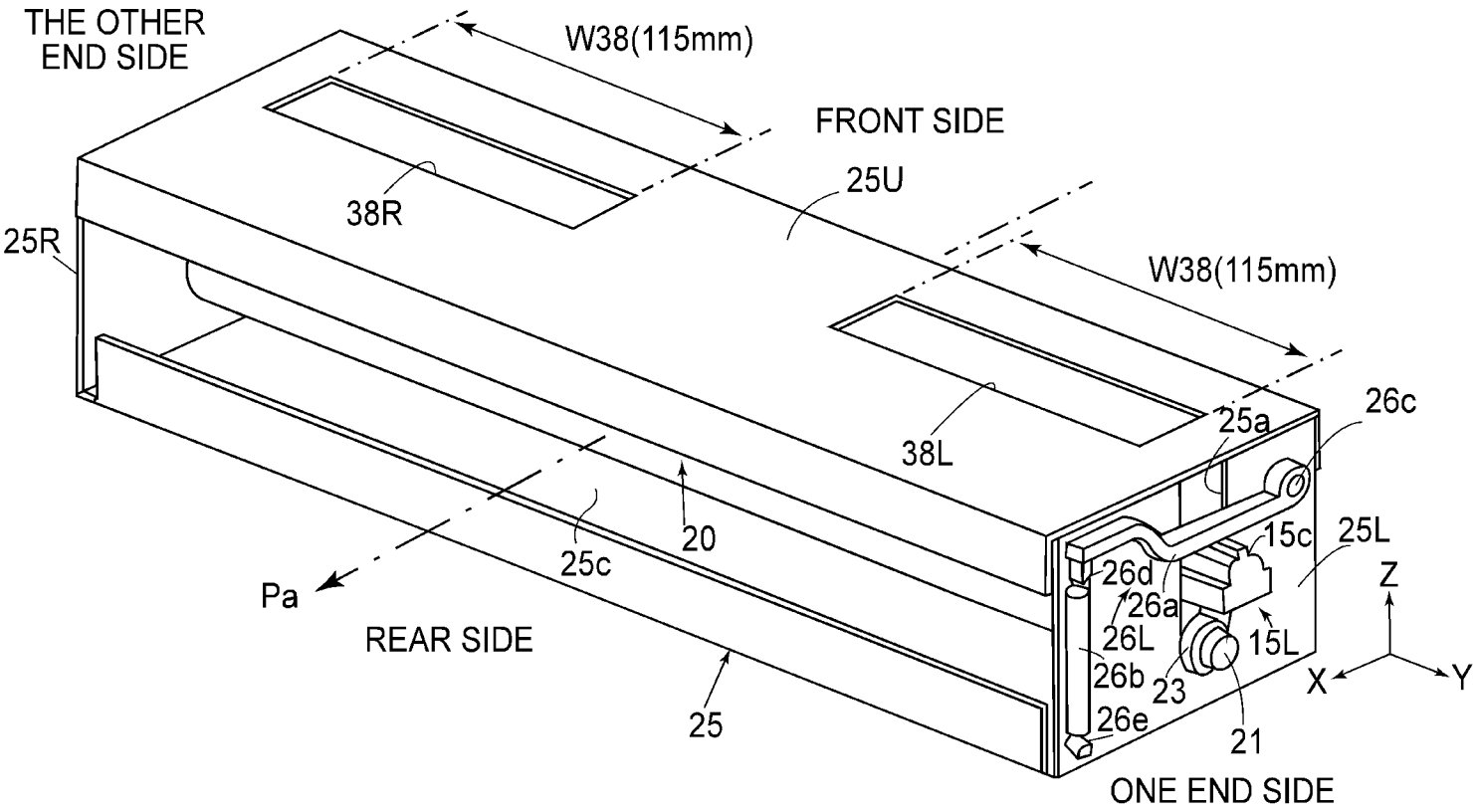
FIG. 5 is a schematic perspective view showing a state of the fixing device of FIG. 3 from which an air blowing cooling mechanism provided on an upper surface side of a device frame is removed.
Figure 6:
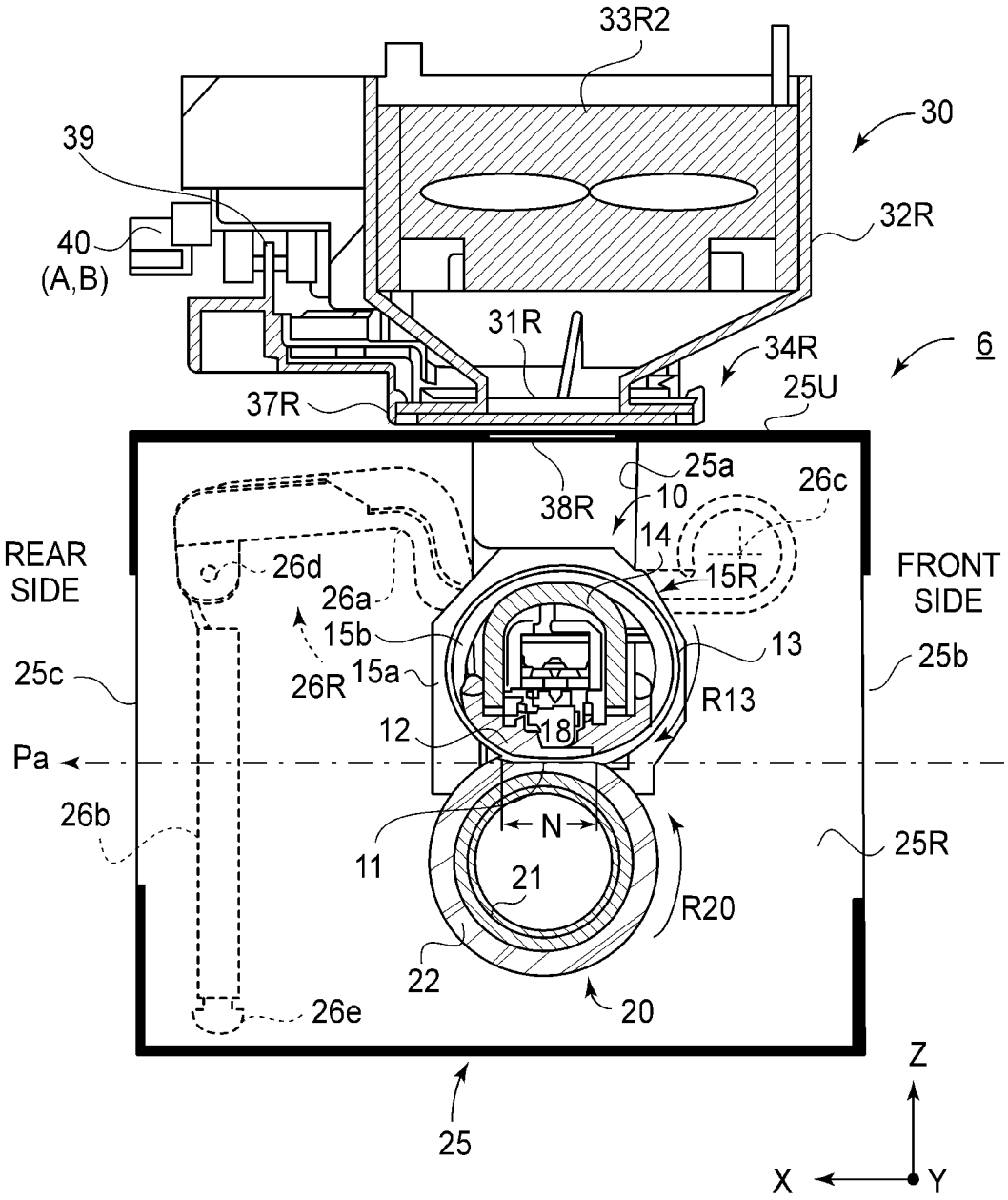
FIG. 6 is a schematic sectional view of the fixing device taken along (6)-(6) line of FIG. 3.
Figure 7:
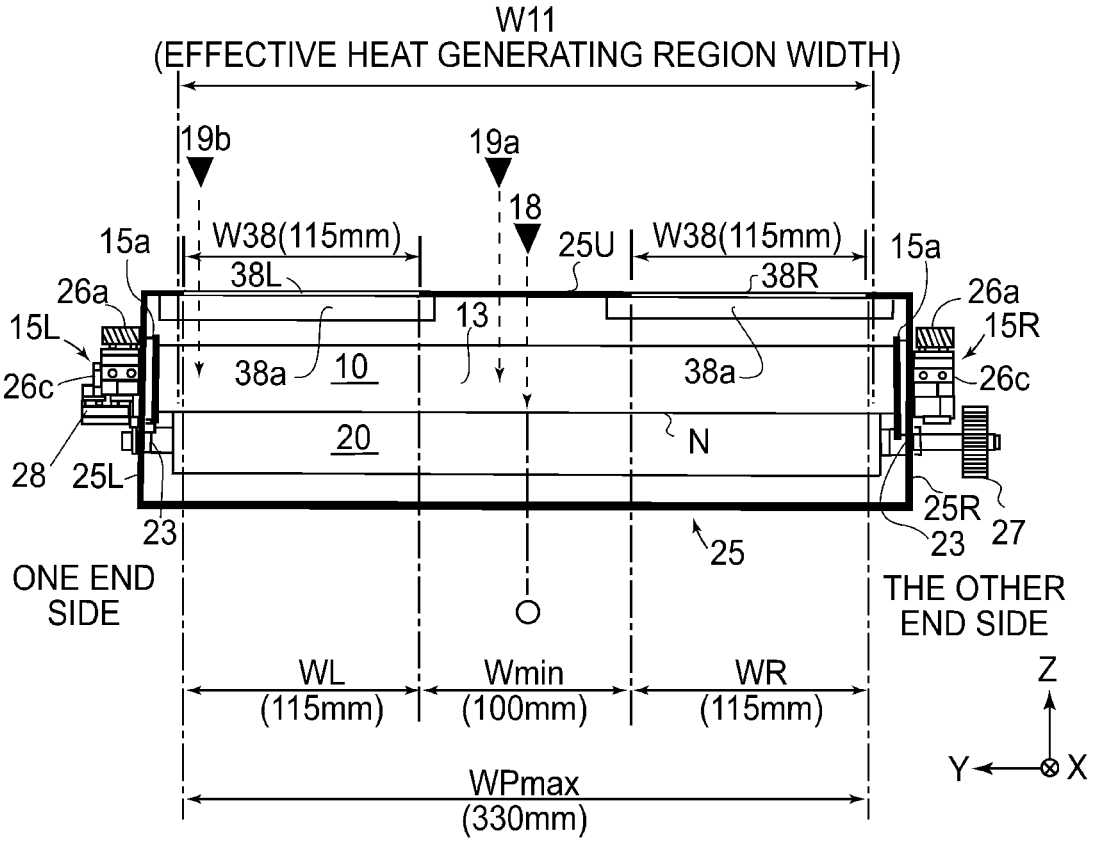
FIG. 7 is a schematic front view of the fixing device of FIG. 5 which is partially cut away.
Figure 8:
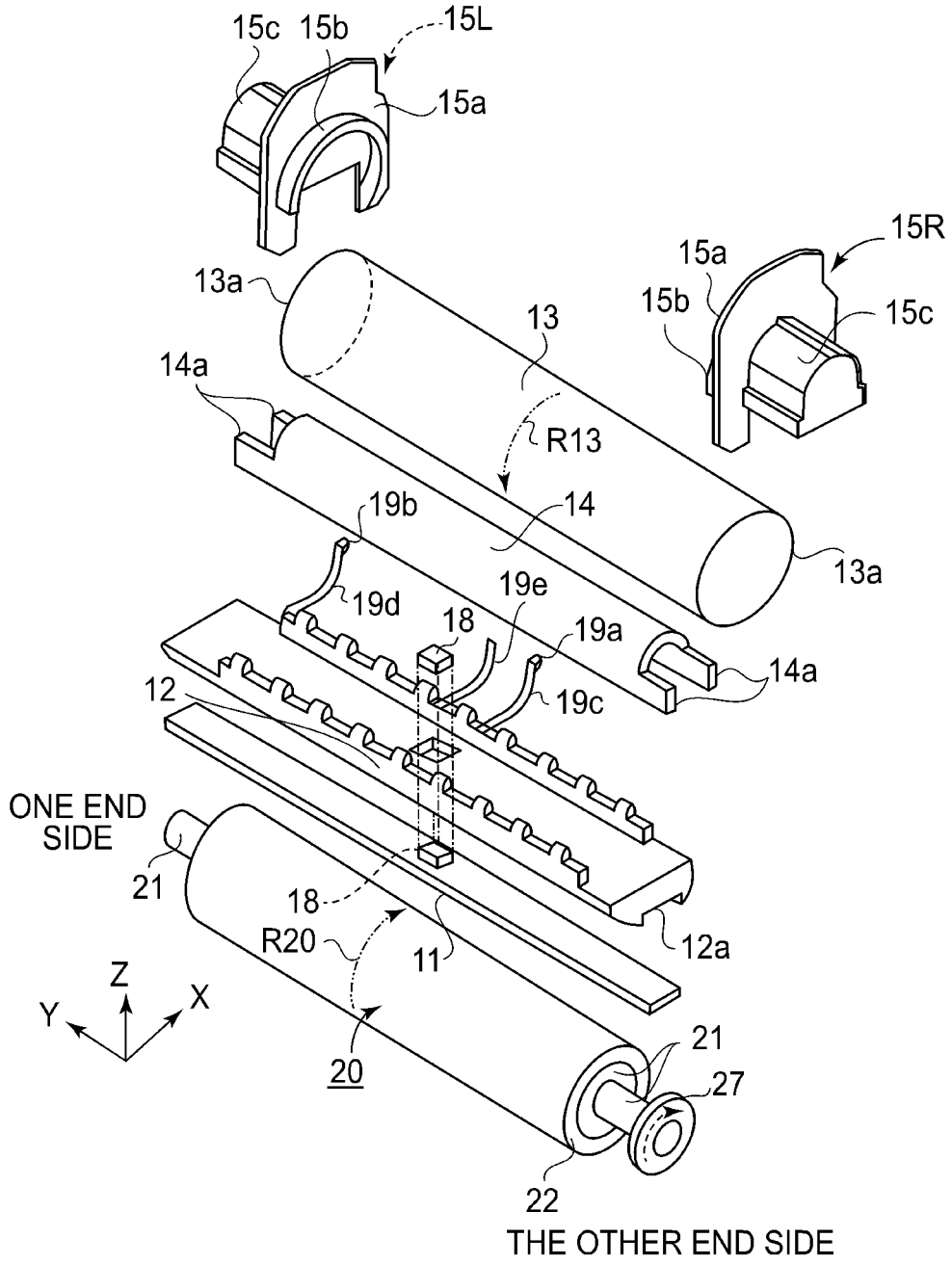
FIG. 8 is a schematic exploded perspective view of a fixing assembly (fixing member).
Figure 9:
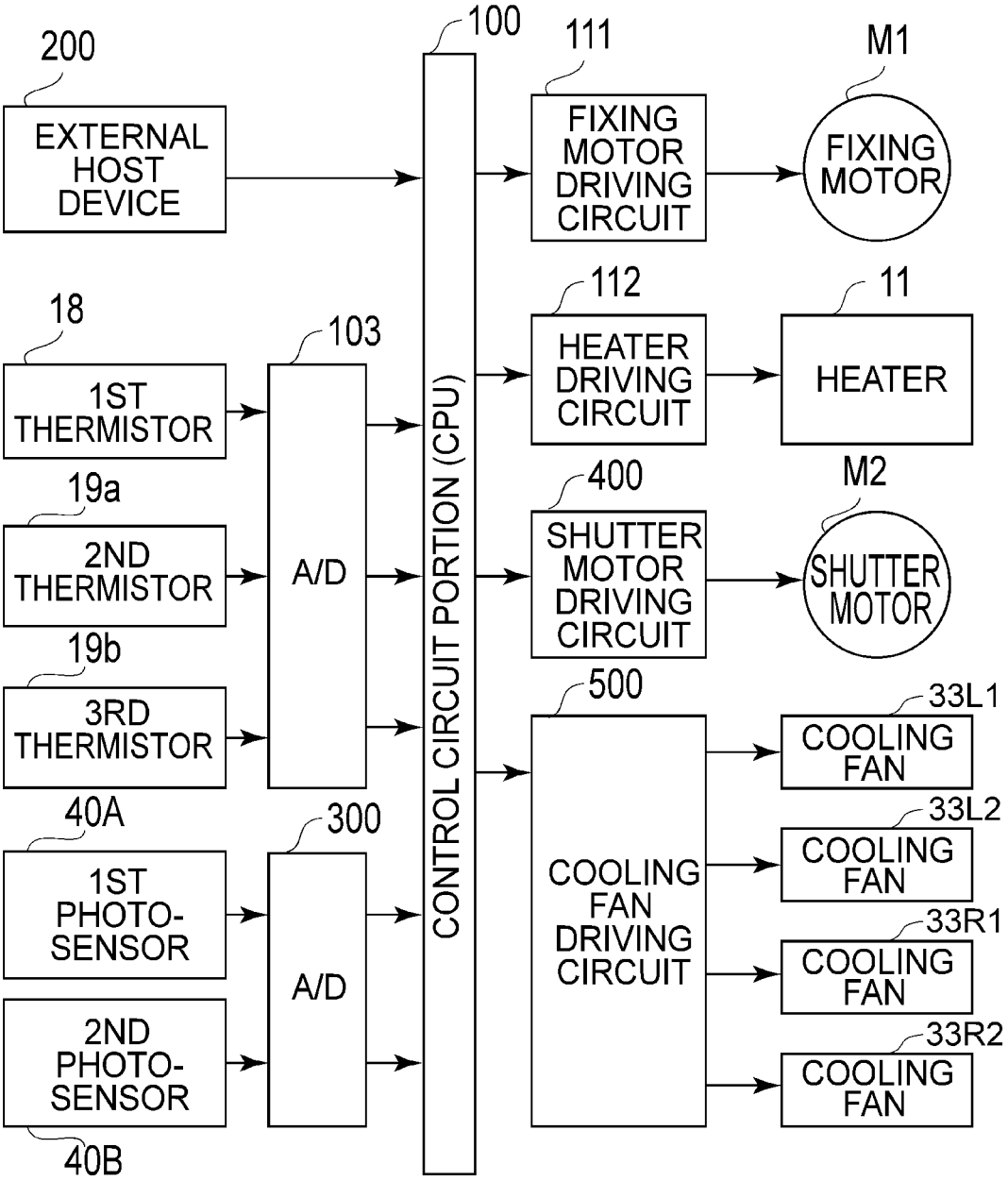
FIG. 9 is a block diagram of a control system principally of the fixing device.

FIG. 3 is a schematic perspective view of an outer appearance of the fixing device 6 on a rear side, one end side and an upper surface side. FIG. 4 is a schematic perspective view of an outer appearance of the fixing device 6 on the other end side. FIG. 5 is a schematic perspective view showing a state of the fixing device 6 of FIG. 3 from which an air blowing cooling mechanism 30 provided on an upper surface side of a device frame is removed. FIG. 6 is a schematic sectional view of the fixing device 6 taken along (6)-(6) line of FIG. 3. FIG. 7 is a schematic front view of the fixing device 6 of FIG. 5 which is partially cut away. FIG. 8 is a schematic exploded perspective view of a fixing assembly. FIG. 9 is a block diagram of a control system principally of the fixing device 6.

This fixing device 6 is an image heating apparatus of a film heating type. The fixing device 6 roughly includes a fixing assembly (fixing member) 10 provided with a fixing film 13, a pressing roller (fixing member) 20 having elasticity, a (fixing) device frame (device casing) 25 accommodating these members 10 and 20, and an air blowing cooling mechanism 30. In the following, the fixing assembly 10 is similarly referred to as the assembly 10. A nip (fixing nip) N is formed by cooperation between the fixing film 13 (rotatable heating member: first rotatable member) and the pressing roller 20 (rotatable pressing member: second rotatable member) which are used as a pair of rotatable members) (FIGS. 6 and 7).

The nip N is a portion where the sheet P carrying thereon an unfixed toner image is nipped and fed and thus the toner image is fixed on the sheet P under application of heat and pressure. In the nip N, the fixing film (fixing belt) 13 contacts the surface of the sheet P on which the unfixed toner image is carried.

The assembly 10 is, as shown in FIG. 6, an assembly of a cylindrical (endless, endless belt-shaped) fixing film 13, a heater 11, a heat-insulating holder 12, a pressing stay (metal stay) 14, fixing flanges 15 (L, R) and the like. FIG. 8 is an exploded perspective view of this assembly 10, and the pressing roller 20 is also illustrated together with the assembly 10.

(1) Fixing Film

The fixing film (fixing belt, flexible sleeve, hereinafter referred to as a film) 13 is a thin endless heat transfer member having flexibility and a heat-resistant property, and assumes a substantially cylindrical shape in a free state thereof by its own elasticity.

The film 13 is a heat-resistant film of 200 μm or less in thickness in order to enable quick start. The film 13 is formed of, as a material of a base layer, a heat-resistant resin material such as polyimide, polyamideimide or PEEK (polyether ether ketone), or pure metal, having a heat-resistant property and a high heat transfer property, such as SUS (stainless steel), Al, Ni, Cu or Zn, or an alloy of these metals.

In the case of the base layer made of the resin material, in order to improve the heat transfer property, heat transfer powder of BN, alumina, Al or the like may also be mixed in the base layer. Further, in order to constitute fixing device having a long lifetime, as a film 13 having sufficient strength and excellent in durability, the film 13 may preferably have a total thickness of 100 μm or more. Therefore, as the total thickness of the film 13, a total thickness of 100 μm or more and 200 μm or less is an optimum thickness.

Further, in order to prevent offset and to ensure a separating property of the sheet P, as a surface layer, a parting layer made of a heat-resistant resin material having a good parting property, which is a fluorine-containing resin material such as PTFE, PFA, FEP, ETFE, CTFE or PVDF or a silicone resin material is formed and coated on the base layer singly or in mixture. In this embodiment, the surface layer is constituted by a material at least containing PTFE and PFA.

Here, PTFE is polytetrafluoroethylene, PFA is a tetrafluoroethylene-perfluoroalkylvinyl ether copolymer, and FEP is a tetrafluoroethylene-hexafluoropropylene copolymer. Further, ETFE is an ethylenetetrafluoroethylene copolymer, CTFE is polychlorotrifluoroethylene, and PVDF is poly (vinylidene fluoride).

As a coating method, the parting layer may be coated on an outer surface of the film 13 after being subjected to etching, by dipping, powder spraying or the like. Or, a type in which the surface of the film 13 is coated with a resin material formed in a tube shape may also be employed. Or, a method in which the outer surface of the film 13 is subjected to blasting and thereafter a primer layer of an adhesive is coated on the blasted surface of the film 13 and then the parting layer is coated on the primer layer may also be employed.

(2) Heater

The heater 11 is an elongated plate-shaped heat generating element in which a full length portion having an effective heat generating region width W11 (FIG. 7) is abruptly increased in temperature by energization and which has low thermal capacity, and is a ceramic heater in this embodiment. In this heater 11, the heat generating element (heat generating resistor, an energization heat generating resistor layer) is formed by printing electroconductive paste of Ag—Pd or the like in a thick film (layer) on an elongated thin plate-shaped substrate (ceramic substrate) of AlN (aluminum nitride) having a good heat-transfer property.

Then, on the heat generating elements, as a slidable insulating member, an about 50-60 μm thick glass coating layer is provided integrally with the heat generating element, so that the ceramic heater is constituted. In this embodiment, the glass coating layer side is a heater front surface side and the ceramic heater contacts an inner surface of the film 13 on this side.

The heat generating element is formed along the longitudinal direction of the substrate in a length corresponding to a width of a maximum-width size sheet usable in the fixing device or a length longer than the above length by a predetermined distance. A length range of this heat generating element is the effective heat generating region width W11 of the heater 11. In the heater 11, on the substrate (on the heater rear surface side) opposite from a side where the heat generating element is provided, a chip-shaped thermistor (first thermistor) 18 (FIGS. 6 and 8) as a temperature detecting element is provided while sandwiching the substrate between itself and the heat generating element. This thermistor 18 is fixed to the substrate (heater rear surface) with predetermined pressure by a pressing means (not shown) such as a spring.

(3) Heating Insulating Holder

The heat insulating holder (heater holding member, hereinafter referred to as a holder) 12 is an elongated member extending along the longitudinal direction (widthwise direction) of the film 13 and is formed of a heat-resistant resin material such as a liquid crystal polymer, a phenolic resin, PPS or PEEK. With a decreasing thermal conductivity, heat of the heater 11 is less taken, so that heat can be efficiently conducted to the film 13, and therefore, a filler such as a glass balloon or a silica balloon may also be incorporated in the resin layer. The heater 11 is engaged in and held by a groove 12*a* (FIG. 8) formed on a lower surface of the holder 12 along the longitudinal direction of the holder 12 in a state in which a front surface thereof faces the inner surface of the film 13. Further, the holder 12 also has a function of guiding rotation of the film 13.

(4) Pressing Stay

The pressing stay 14 is a rigid member which extends along the longitudinal direction of the film 13 and which receives a reaction force from the pressing roller 20, and may desirably be formed of a material which is not readily flexed even under application of a high pressure. In this embodiment, the stay 14 is a metal stay and uses a molded member of SUS 304 having a U-shape in cross section. The stay 14 is provided on an upper surface side of the holder 12 and contacts the holder 12, so that flexure and twisting of an entirety of the assembly 10 are suppressed.

(5) Fixing Flanges

The film 13 is externally engaged (fitted) loosely with an assembly (assembled member) of the heater 11, the holder 12 and the stay 14. Both end portions 14*a* (FIG. 8) of the stay 14 project toward outsides of the film 13 through openings formed at both end portions of the film 13, fixing flanges 15(L, R) on one end side and the other end side, respectively, are engaged with the associated end portions 14*a*, respectively, of the stay 14. The film 13 is positioned between opposing end portion regulating (preventing) surfaces (opposing collar seat portions) 15*a* of the engaged flanges 15(L, R).

The flanges 15(L, R) are regulating (preventing) members for regulating (preventing) movement of the film 13 in the longitudinal direction and a shape of the film 13 with respect to a circumferential direction and are molded products of a heat-resistant resin material such as PPS, the liquid crystal polymer, the phenolic resin or the like. Each of the flanges 15(L, R) includes the end portion regulating surface 15*a*, an inner periphery regulating surface 15*b* and a portion-to-be-pressed (pressure-receiving portion) 15*c*.

(6) Pressing Roller

The pressing roller 20 as the rotatable member is an elastic roller including a core metal 21 of SUS, SUM (sulfur and sulfur composite free-cutting steels), Al or the like and including an elastic layer 22, formed outside the core metal 21, such as an elastic solid rubber layer, an elastic sponge rubber layer or an elastic foam rubber layer.

Here, the elastic solid rubber layer is formed of a heat-resistant rubber such as a silicone rubber or a fluorine-containing rubber. Further, the elastic sponge rubber layer is formed by foaming a silicone rubber in order to impart an heat-insulating effect. Further, the elastic foam rubber layer is formed by dispersing a hollow filler (microballoons or the like) in a silicone rubber layer, so that a hardened product is provided therein with a gas portion and thus the heat-insulating effect is enhanced. On these layers, a parting layer of a perfluoroalkoxy resin (PFA), polytetrafluoroethylene resin (PTFE) or the like may also be formed.

The pressing roller 20 is supported between side plates 25(L, R) on one end side and the other end side of the device frame 25 so as to be rotatable via bearings 23 on one end side and the other end side of the core metal 21.

The assembly 10 is disposed between the side plates 25(L, R) in parallel to the pressing roller 20 so that the heater 11 side is opposed to an upper side of the pressing roller 20. The flanges 15(L, R) in the assembly 10 are engaged with guiding holes 25*a* formed symmetrically in the side plates 25(L, R) so that the portions-to-be-pressed 15*c* thereof are slidable (movable) in a direction toward the pressing roller 20.

Then, the flanges 15(L, R) receive predetermined pressing forces in the direction toward the pressing roller 20 at the portions-to-be-pressed 15*c* by pressing arms 26*a* of a pressing mechanism 26 on one end side and the other end side. By the pressing forces, an entirety of the flanges 15(L, R), the stay 14, the holder 12 and the heater 11 of the assembly 10 is pressed in the direction toward the pressing roller 20. For that reason, a part of the heater 11 and a part of the holder 12 are pressed toward the pressing roller 20 through the film 13 against elasticity of the elastic layer 22 by the predetermined pressing forces. As a result, the nip N with a predetermined width with respect to the sheet feeding direction Pa is formed between the film 13 and the pressing roller 20.

Referring to FIGS. 3 and 4, outside the side plates 25(L, R) on one end side and the other end side of the frame 25, the pressing mechanisms 26(L, R) on one end side and the other end side are provided, respectively. These pressing mechanisms 26(L, R) have a mirror symmetrical constitution and have the same structure.

Each of the pressing mechanisms 26(L, R) includes a pressing lever (arm) 26*a* and a pressing spring 26*b*. The lever 26*a* is mounted to the associated one of the side plates 25(L, R) on a base portion side thereof so s to be swingable about a shaft portion 26*c*. The lever 26*a* extends from the shaft portion 26*c* to a side opposite from the shaft portion 26*c* side via an upper side of the associated one of the portions-to-be-pressed 16*c* of the flanges 15(L, R).

The spring 26*b* is an elastic member for rotationally urging the lever 26*a* about the shaft portion 26*c* in a pressing (urging) direction by bringing the lever 26*a* into contact with the associated one of the portions-to-be-pressed 15*c* of the flanges 15(L, R). In this embodiment, the spring 26*b* is stretched between a free end portion 26*d* and a pin shaft 26*e* implanted in the associated one of the side plates 25(L, R). Accordingly, the lever 26*a* is contacted to the associated one of the portions-to-be-pressed 15*c* of the flanges 15(L, R) by a tensile force of the spring 26 and imparts the predetermined pressing force to the associated portion-to-be-pressed 15*c*.

The lever 26*a* is supported rotatably relative to the associated one of the side plates 25(L, R), so that rotational moment generates about the shaft portion 26*c* by the tensile force of the spring 26*b* and thus the associated one of the flanges 15(L, R) is pressed in the direction toward the pressing roller 20 by the pressing force.

(7) Fixing Operation

On the other end side (driving side) of the core metal 21 of the pressing roller 20, a driving gear 27 (FIGS. 4 and 8) is provided concentrically integral with the core metal 21. To this gear 27, a driving force of a fixing motor (driving source) M1 driven by a fixing motor driving circuit 111 controlled by the control circuit portion 100 (FIG. 9) is transmitted through a drive transmitting mechanism (not shown). As a result, the pressing roller 20 is rotationally driven as a rotatable driving member at a predetermined speed in the counterclockwise direction of an arrow R20 shown in FIG. 6.

By rotationally driving the pressing roller 20, rotational torque acts on the film 13 in the nip N by a frictional force between the film 13 and the pressing roller 20. The pressing roller 20 functions as a rotatable member for rotating the film 13. The film 13 is rotated by the pressing roller 20. As a result, the film 13 is rotated around the assembly of the heater 11, the holder 12 and the stay 14 in the clockwise direction of an arrow R13 shown in FIG. 6 while an inner surface of the film 13 slides on the part of the heater 11 and the part of the holder 12 in the nip N in close contact with the part of the heater 11 and the part of the holder 12. A rotational peripheral speed of the film 13 substantially corresponds to a rotational peripheral speed of the pressing roller 20.

The end portion regulating (preventing) surfaces 15*a* of the flanges 15(L, R) contact end surfaces (edge surfaces) 13*a* (FIG. 8) of the rotating film 13 and thus prevent movement of the film 13 in the longitudinal direction (thrust direction) of the film 13. The inner periphery regulating surfaces 15*b* are guiding surfaces for supporting an inner peripheral surface of the film 13 at end portions of the film 13 from an inside of the film 13, and are provided as arcuately projected edge portions toward the inner surface side of the flanges 15(L, R). Between the film 13 and the heater 11, a lubricant such as heat-resistant grease of a fluorine-containing type, a silicone type or the like is interposed, whereby a friction resistance is suppressed to a low level and thus the film 13 is rotatable (movable) smoothly.

The control circuit portion 100 controls a heater driving circuit portion 112 and thus starts energization to the heater 11. Although an energization path from the heater driving circuit portion 112 toward the heater 11 is omitted from illustration, the energization is carried out via wiring electrically connecting the heater driving circuit portion 112 with the heater 11 and a connector 28 (FIG. 7). By this energization, a full length region of the effective heat generating region W11 (FIG. 7) of the heater 11 abruptly increases in temperature.

A temperature of the heater 11 is detected by the first thermistor 18 provided on the rear surface of the heater 11, so that detection temperature information is inputted to the control circuit portion 100 through an A/D converter 103. Further, inner surface temperatures of the film 13 rotating while being heated by the heater 11 are detected by second and third thermistors 19*a* and 19*b* (FIGS. 7 and 8), so that pieces of detection temperature information are inputted to the control circuit portion 100 through the A/D converter 103.

The control circuit portion 100 determines and appropriately controls a duty ratio, wave number and the like of a voltage applied from the heater driving circuit 112 to the heater 11, depending on the pieces of the detection temperature information (outputs) inputted from the first to third thermistors 18, 19*a* and 19*b*. As a result, the temperature in the nip N is increased to a predetermined fixing set temperature, so that temperature control is carried out.

In the above state of the fixing device 6, the sheet P on which the unfixed toner image is formed is introduced from the image forming portion A1 into the fixing device 6 through an introducing port 25*b* (FIG. 6) on the front side of the frame 25 and is nipped and fed through the nip N. To the sheet P, heat of the heater 11 is imparted through the film 13 in a process in which the sheet P is nipped and fed through the nip N. The unfixed toner image is melted by the heat of the heater 11 and is fixed as a fixed image on the sheet P by heat and pressure applied to the nip N. Then, the sheet P coming out of the nip N is discharged to an outside of the fixing device 6 through a discharging port 25*c* of the device frame 25.

Incidentally, inside the frame 25, a sheet guiding member, a sheet sensor and the like are provided between the introducing port 25*b* and the nip N, and a sheet guiding member, a discharging roller pair, a sheet sensor and the like are provided between the nip N and the discharging port 25*c*, but these members are omitted from the figures.

Here, in this embodiment, the sheet P is fed to the fixing device 6 on a so-called center (line) feeding basis. Here, center (line) feeding refers to a method in which when sheets different in size are fed, these sheets are fed so that centers (center lines) of the respective sheets with respect to the widthwise direction (perpendicular to the recording material (sheet) feeding direction) of the sheets coincide with each other. In FIG. 7, "O" represents a reference line (center reference line, phantom line) as the center line in the center (line) feeding.

In FIG. 7, "WPmax" is a sheet passing region width of a maximum width sheet usable in the apparatus. In this embodiment, the width of the maximum width sheet usable in the apparatus is 330 mm. "WPmin" is a sheet passing region width of a minimum width sheet usable in the apparatus. In this embodiment, the width of the minimum width sheet usable in the apparatus is 100 mm which is a postcard width. In the case where the minimum width sheet is fed by the center (line) feeding (sheet passing) basis, with respect to the widthwise direction, non-sheet-passing portions exist outside WPmin on both sides (one end side and the other end side).

The effecting heat generating region width W11 of the heater 11 is set so as to be equal to the sheet passing region width WPmax or larger than the sheet passing region width WPmax by a predetermined width. The first thermistor 18 is disposed in contact with the rear surface of the heater 11 at a heater rear surface position substantially corresponding to the center reference line O.

The second thermistor 19*a* detects the film temperature in contact with the inner surface of the film 13 at a position which is downstream of the nip N with respect to the film rotational direction and which substantially corresponds to the center reference line O. The third thermistor 19*b* detects the film temperature in contact with the inner surface of the film 13 at a position which is downstream of the nip N with respect to the film rotational direction and which substantially corresponds to an inside position of an end of the sheet passing region width WPmax.

That is, the second thermistor 19*a* detects a temperature of a film portion corresponding to a portion within the sheet passing region width WPmax which is a sheet passing portion common to any sheets having large and small (various) sizes usable in the apparatus. The third thermistor 19*b* detects a temperature of a film portion corresponding to the non-sheet-passing portion when a sheet narrower in width than the maximum width sheet is passed through the nip N (FIG. 7).

The second and third thermistors 19*a* and 19*b* are supported at free end portions of elongated spring members 19*c* and 19*d*, respectively (FIG. 8). Base portions of the spring members 19*c* and 19*d* are fixed to the holder 12. That is, the second and third thermistors 19*a* and 19*b* are supported by the spring members 19*c* and 19*d*, respectively, so as to elastically contact and slide with the inner surface of the film 13. Further, the second and third thermistors 19*a* and 19*b* are mounted so that in a free state, free ends thereof project with a spring property to an outside of a projection shape of the film 13 during mounting of the film 13.

Further, the stay 14 made of metal is provided with a grounding member 19*e* (FIG. 8) contacting the inner surface of the film 13 in the neighborhood of the second thermistor 19*a* for the purpose of establishing the grounding of the film 13. The grounding member 19*e* is an elongated spring member in which a base portion is electrically conducted to the stay 14 and a free end portion slides with the inner surface of the film 13 in elastic contact with the film inner surface. This grounding member 19*e* is also mounted similarly as in the case of the second and third thermistors 19*a* and 19*b* so that in a free state, a free end thereof projects with a spring property to the outside of the projection shape of the film 13 during the mounting of the film 13.

(Air Blowing Cooling Mechanism)

The air blowing cooling mechanism 30 will be described. The air blowing cooling mechanism 30 is a cooling means for preventing the non-sheet-passing portion temperature rise of the assembly 10 occurring when sheets narrower in width than the maximum width sheet usable in the apparatus are continuously passed through the nip N.

The air blowing cooling mechanism 30 includes ducts 32(L, R) provided with air blowing ports 31(L, R) and fans 33(L, R) for blowing air toward the air blowing ports 31(L, R) through the ducts 32(L, R) in order to cool predetermined regions of the film 13 which is the rotatable heating member.

Further, the air blowing cooling mechanism 30 includes first shutter members 37(L, R) having first surfaces for closing the air blowing ports 31(L, R) in closing positions for closing the air blowing ports 31(L, R) and includes second shutter members 36(L, R) having second surfaces for closing the air blowing ports 31(L, R) in a closing position for closing the air blowing ports 31(L, R).

The air blowing cooling mechanism 30 is supported by a supporting member (not shown) on an upper side of an upper surface plate (top plate) 25U of the frame 25 and is provided close to the upper surface plate 25U in a predetermined manner. The air blowing cooling mechanism 30 has an inlet port surface on the upper side thereof and an air blowing port surface on a lower side thereof, and the air blowing port surface of the air blowing cooling mechanism 30 is provided opposed to and in proximity to the upper surface of the upper surface plate 25U in a predetermined manner.

Figure 10:
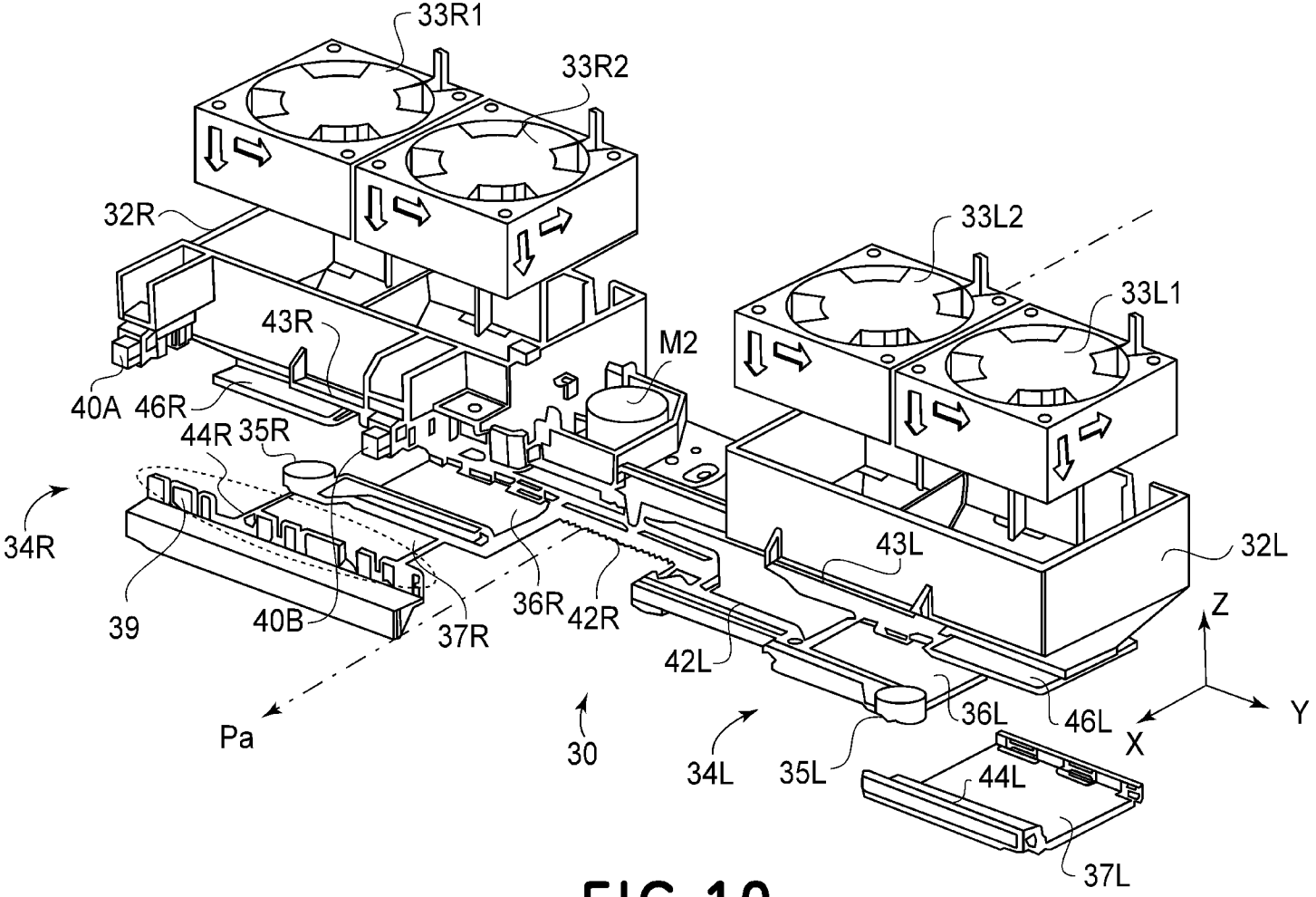
FIG. 10 is an exploded perspective view of the air blowing cooling mechanism of FIG. 3 as seen form an inlet (intake) port side.
Figure 11:
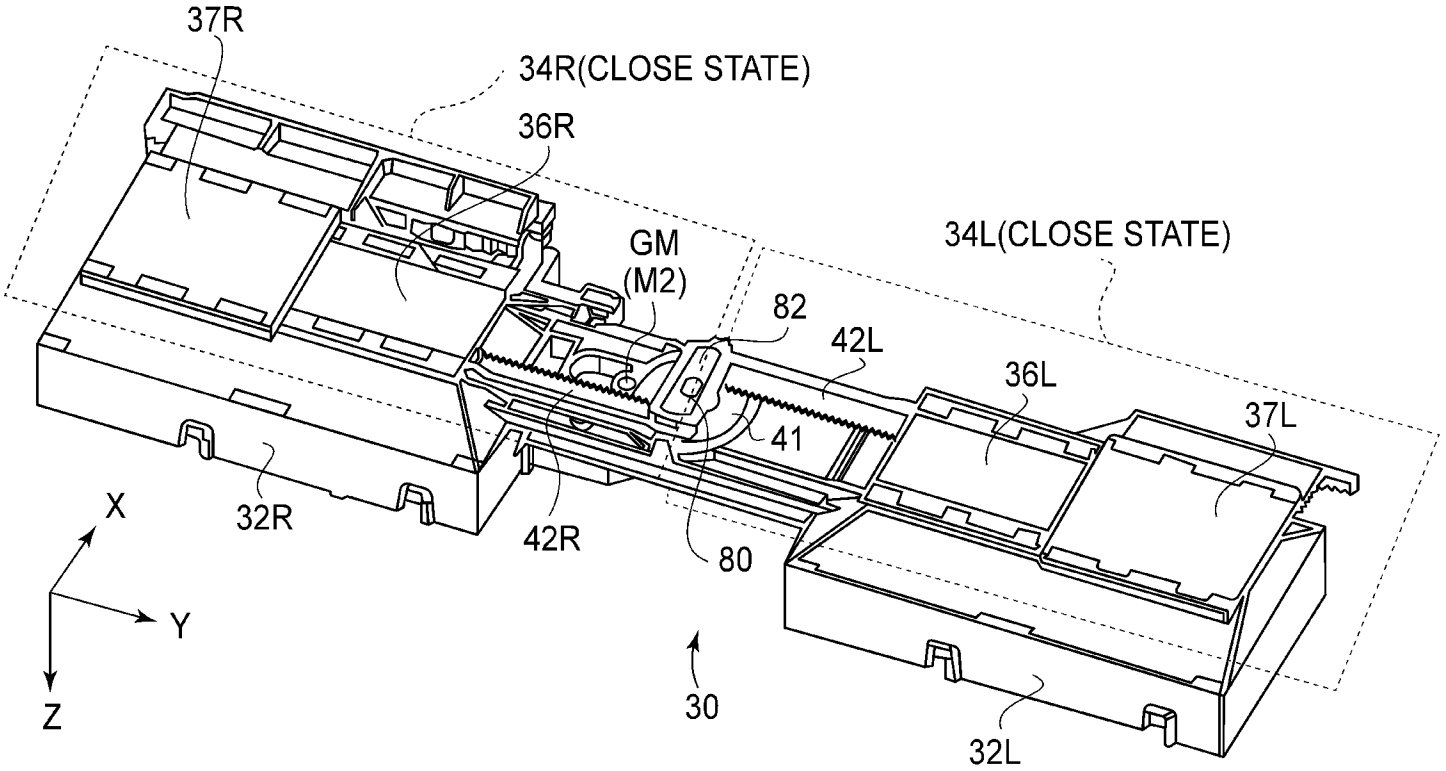
FIG. 11 is a perspective view of the air blowing cooling mechanism of FIG. 3 which is turned upside down and which is as seen from an air blowing port side, in which a shutter mechanism is in a shutter close state.
Figure 12:
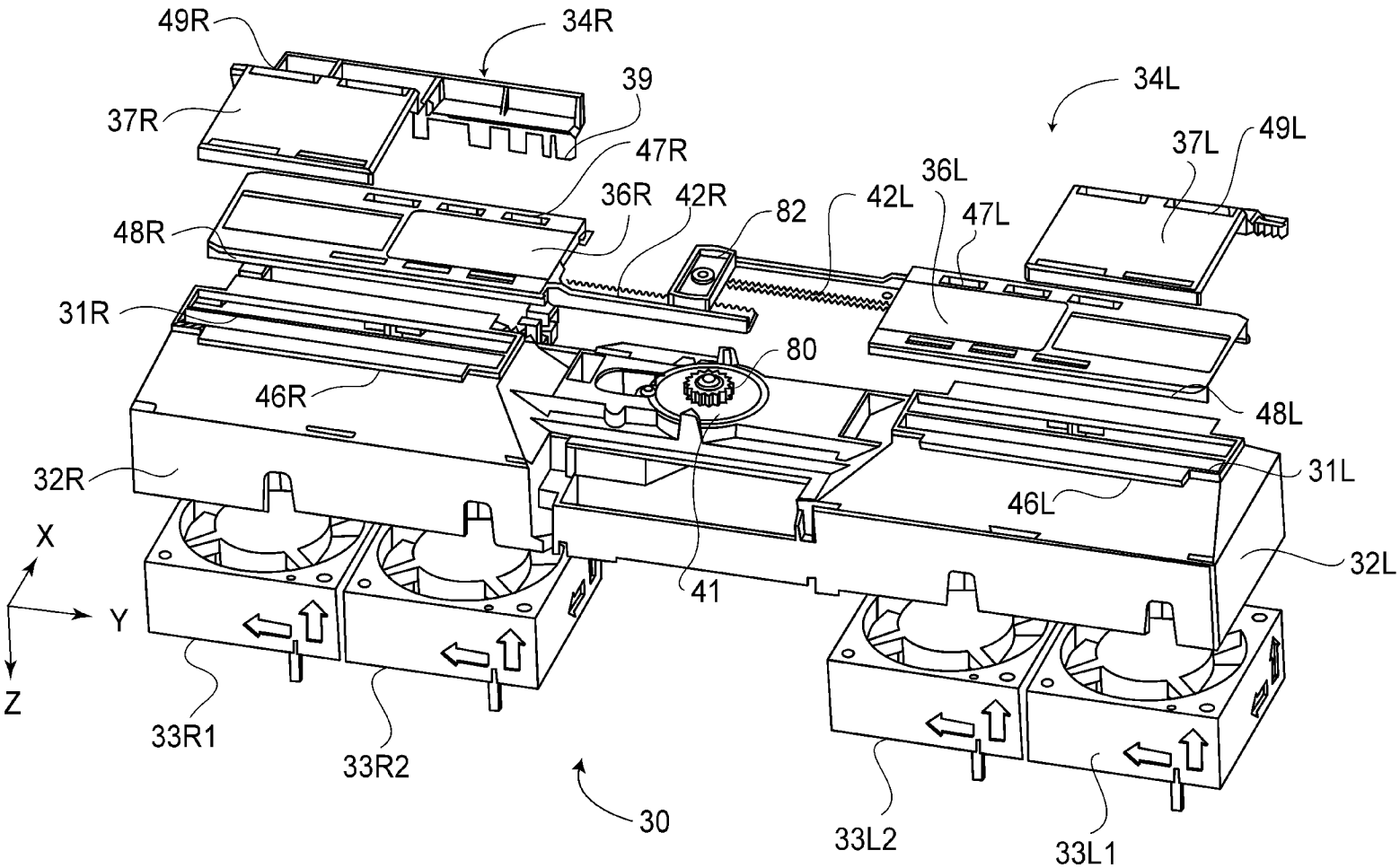
FIG. 12 is an exploded perspective view of the air blowing cooling mechanism of FIG. 11.
Figure 13:
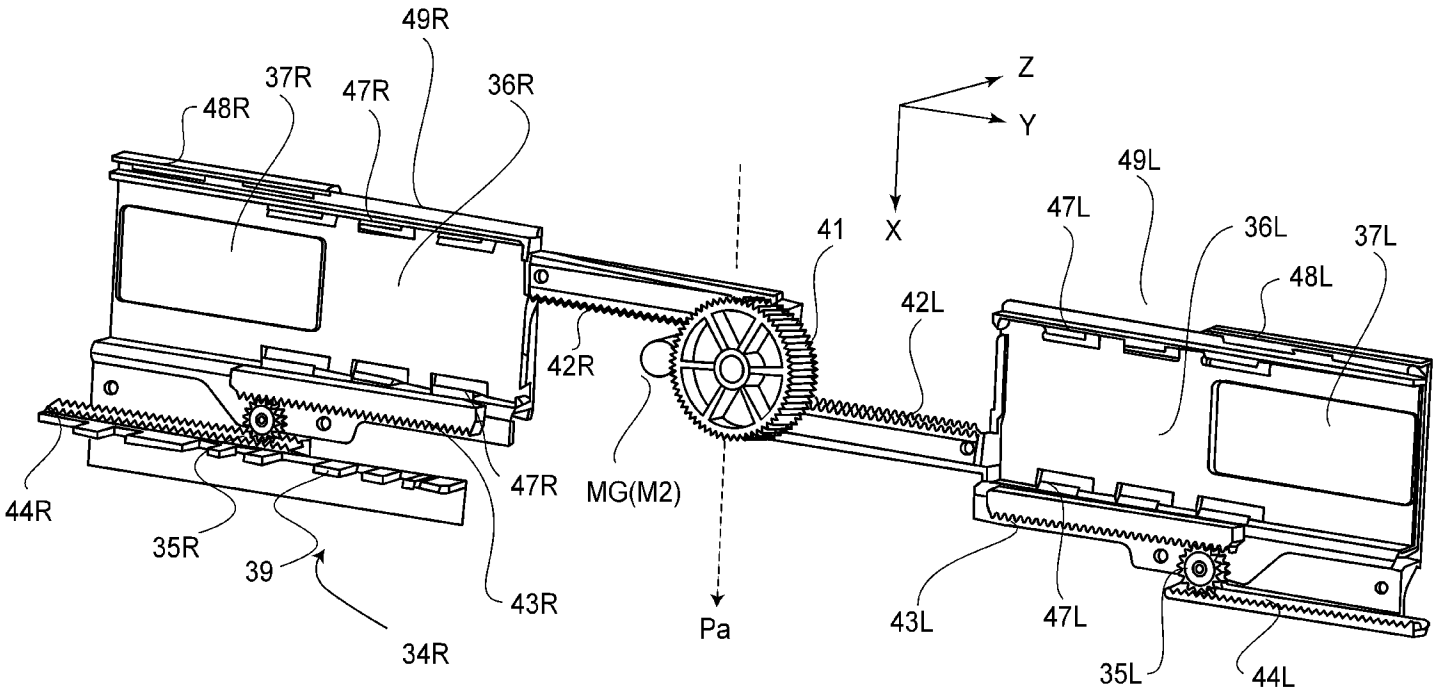
FIG. 13 is a perspective view showing only the shutter mechanism as seen from an inside of the shutter mechanism.

FIG. 10 is an exploded perspective view of the air blowing cooling mechanism 30 of FIG. 3 as seen form an inlet (intake) port side. FIG. 11 is a perspective view of the air blowing cooling mechanism 30 of FIG. 3 which is turned upside down and which is as seen from an upward air blowing port side, in which shutter mechanisms 34(L, R) described later are in a shutter member close state. FIG. 12 is an exploded perspective view of the air blowing cooling mechanism 30 of FIG. 11. FIG. 13 is a perspective view showing only the shutter mechanisms 34(L, R) as seen from an inside of the shutter mechanisms 34(L, R).

Figure 14:
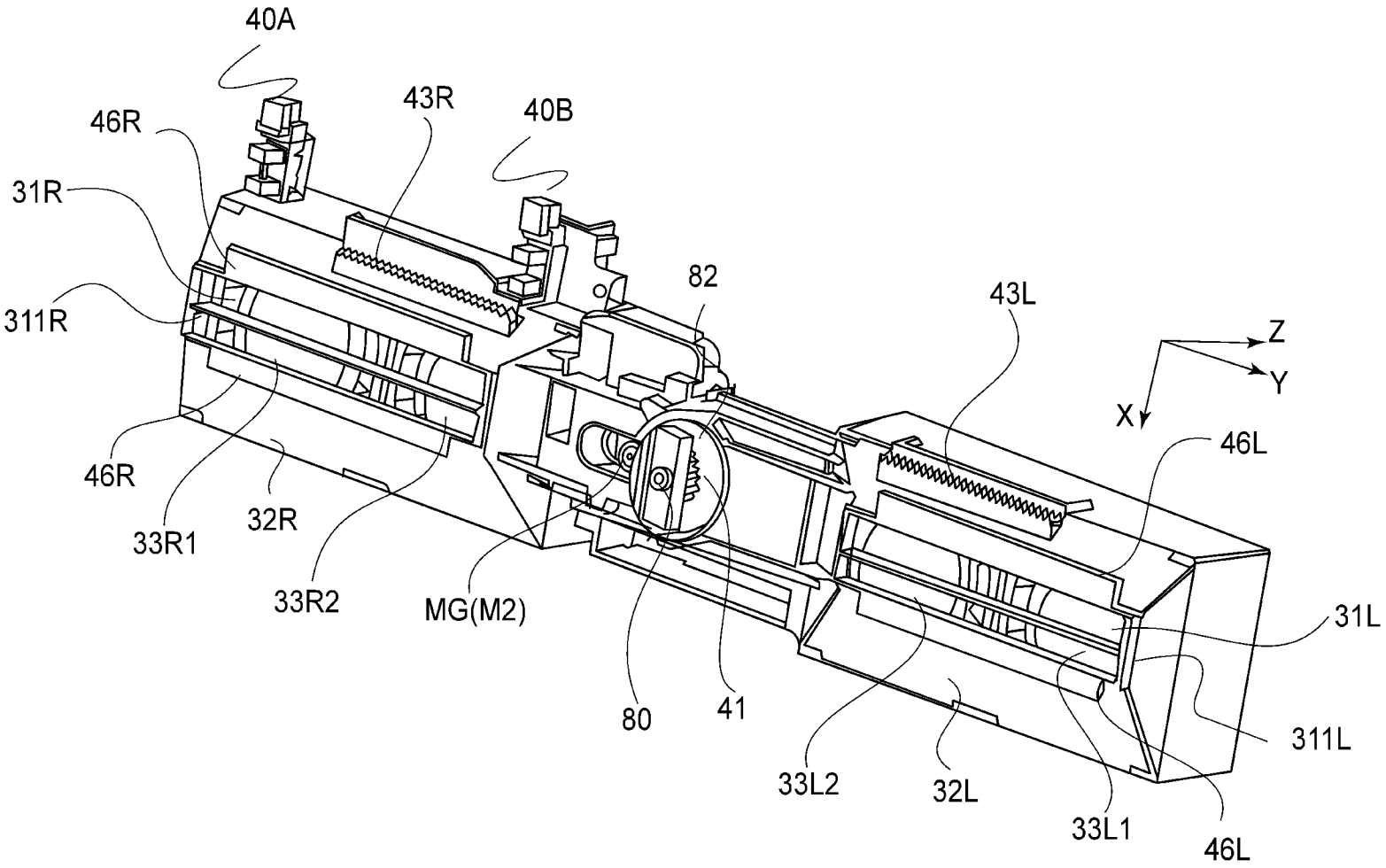
FIG. 14 is a perspective view showing an air blowing cooling mechanism portion which is a portion of the air blowing cooling mechanism of FIG. 11 from which a shutter member is removed, in which the air blowing cooling mechanism portion is seen from the air blowing port side.

FIG. 14 is a perspective view showing an air blowing cooling mechanism portion which is a portion of the air blowing cooling mechanism 30 of FIG. 11 from which shutter members 36L, 37L, 36R and 37R of the shutter mechanisms 34(L, R) are removed, in which the air blowing cooling mechanism portion is seen from the air blowing port side.

As shown in FIG. 5, the upper surface plate 25U is provided with two elongated window holes 38(L, R), extending in the left-right direction on a left-half portion side and a right-half portion side, respectively, for causing cooling air to act on the non-sheet-passing portions of the assembly 10, respectively, by the air blowing cooling mechanism 30. These two window holes 38(L, R) are disposed bilaterally symmetrically with respect to the reference line of the center (line) basis feeding of the sheet P.

Each of the window holes 38(L, R) is, as shown in FIG. 7, positioned so as to oppose an upper surface portion of the assembly 10 and is positioned correspondingly to an associated one of a left-side non-sheet-passing region width WL and a right-side non-sheet-passing region width WR when the minimum-size sheets usable in the apparatus are passed through the nip N. In this embodiment, a width dimension (length dimension) W38 of each of the window holes 38(L, R) is 115 mm(=[(330 mm−100 mm)/2].

The air blowing cooling mechanism 30 includes two elongated dusts 32(L, R) extending in the left-right direction on the left and right sides, respectively. The ducts 32(L, R) include air blowing ports (exhaust ports) 31(L, R) which correspond to the window holes 38(L, R) of the upper surface plate 25, respectively, on a lower surface side thereof and which extend in the left-right direction (FIGS. 12 and 14). Upper surfaces of the ducts 32(L, R) are open as (air) inlet port surfaces.

(1) Shutter and Cooling Fan Constitution

Arrangements of the shutter members and the cooling fans of the cooling apparatus 30 are symmetrical with respect to a rectilinear line passing through a rotation center of a driving pinion gear (first drive transmitting portion) 41 and therefore the arrangement on a right-half portion side will be described as a representative example. Particularly, in the case where there is no description, a left-half portion and a right-half portion have the same constitution.

Inside the right(-side) duct 32R, two right(-side) cooling fans 33(R1, R2) for blowing cooling air to this right duct 32R are provided along the left-right direction. Further, the right duct 32R includes a partition portion provided at a position corresponding to a boundary between the cooling fans 33(R1, R2), so that the air of each of the fans 33(R1, R2) is guided into the air blowing port 31R.

Further, the air blowing cooling mechanism 30 includes the shutter mechanism 34 functioning as an opening width adjusting mechanism for adjusting an opening width of the air blowing port 31L of the left duct 32L and an opening width of the air blowing port 31R of the right duct 32R. The shutter mechanism 34 is constituted by a left shutter mechanism 34L for limiting a cooling range of the cooling air sent through the left duct 32L and by a right shutter mechanism 34R for limiting a cooling range of the cooling air sent through the right duct 32R.

The right shutter mechanism 34R including two shutter members is consisting of an outer shutter member (first shutter member) 37R provided on a longitudinal outer side of the assembly 10 and an inner shutter member (second shutter member) 36R provided on a longitudinal central (inner) side of the assembly 10. Further, the right shutter mechanism 34R is constituted by a shutter pinion gear 35R which is a second drive transmitting portion and which is rotatably supported by the inner shutter member 36R, the driving pinion gear 41, a rack-shaped portion (rack teeth) 43R formed in the duct 32R, and the shutter motor M2.

The inner shutter member 36R is provided on the duct 32R in 36R engagement with an inner shutter member regulating portion 46R formed along the longitudinal direction of the air blowing port 31R, and is slidable along the longitudinal direction of the inner shutter member regulating portion 46R.

Further, the outer shutter member 37R engages with collar-shaped outer shutter member regulating portions 49R formed on the inner shutter member 36R with respect to the longitudinal direction of the inner shutter member 36R.

The left-side portion is similarly constituted.

As regards the above-described left and right shutter mechanisms 34(L, R), the driving pinion gear 41 and the shutter motor M2 are constituent members common to the mechanisms 34(L, R). The shutter motor M2 which is a driving source for driving the driving pinion gear 41 of the shutter mechanisms 34(L, R) is provided in the neighborhood of a central portion between the left and right ducts 32L and 32R. The inner shutter members 36(L, R) are provided with the rack-shaped portions 42(L, R) each engaging with the driving pinion gear 41.

The rack-shaped portions 43(L, R) provided on the left and right ducts 32(L, R) are provided so as to engage with the shutter pinion gears 35(L, R) rotatably supported by the shutter members 36(L, R).

The driving pinion gear 41 is rotationally driven normally and reversely by an output gear MG of the shutter motor (pulse motor) M2. in interrelation with normal and reverse rotational drive of this gear 41, the inner and outer shutter members 36(L, R) and 37(L, R) of the left and right shutter mechanisms 34(L, R) are moved as described above for opening and closing the air blowing ports 31(L, R) of the left and right ducts 32(L, R). That is, in this embodiments, the driving pinion gear 41 is a driving member for transmitting drive (driving force) of the shutter motor M2 (output gear MG) which is the driving source to the inner and outer shutter members 36(L, R) and 37(L, R) of the left and right shutter mechanisms 34(L, R).

The inner and outer shutter members 36(L, R) and 37(L, R) of the left and right shutter mechanisms 34(L, R) are controlled so as to be moved to positions corresponding to the width of the sheet P passed through the nip N. As a result, widths of the air blowing ports 31(L, R) of the left and right ducts 32(L, R), i.e., widths of the left and right window holes 38(L, R) in the upper surface plate 25U are adjusted to optimum opening widths corresponding to the passed sheet width, so that air blowing cooling is carried out in ranges in which non-sheet-passing region temperature rise in the assembly 10 occurs.

(2) Shutter (Member) Opening and Closing Operation

A shutter (member) opening and closing operation will be described. The outer shutter member 37R of the right shutter mechanism 34R is provided at a bent edge portion thereof with a plurality of sensor flags 39 (a portion enclosed by a broken line in FIGS. 3 and 10) determined correspondingly to sheets having various width sizes. Further, first and second photo-sensors 40A and 40B for detecting edge portions of the sensor flags 39 are provided by being fixed to the right duct 32R. Edge portion detection information of each of the sensor flags 39 by the first and second photo-sensors 40A and 40B is inputted to the control circuit portion 100 through an A/D converter 300 as shown in FIG. 9.

In this embodiment, the sensor flags 39 and the first and second photo-sensors 40A and 40B are a detecting means for detecting opening (portion) positions of the shutters. The control circuit portion 100 causes a shutter motor driving circuit 400 to control the shutter motor M2 so that an edge portion of the sensor flag 39 corresponding to width size information of the sheet P used, which is inputted from the external host prevent 200 is detected by the second photo-sensor 40B. That is, the shutter motor M2 is subjected to normal rotation control (CW (clockwise)) or reverse rotation control (CCW (counterclockwise)), so that the left and right shutter mechanism 34L and 34R are driven.

Then, at the time when the edge portion of the sensor flag 39 corresponding to width size information of the sheet P which is to be used and passed through the nip N is detected by the second photo-sensor 40B, with the time as a starting point, the shutter motor M2 is driven for several msec and is stopped. As a result, outside edge portions of the outer shutter members 37(L, R) of the left and right shutter mechanisms 34(L, R) are moved to positions corresponding to the width of the sheet P which is to be used and passed through the nip N.

An operation of the left and right cooling fans 33(L1, L2, R1, R2) in the fixing device 6 in this embodiment will be described. During image formation, in the case where sheets smaller in width than a size of maximum width sheets P usable in and passable through the fixing device 6 are continuously fixed by the fixing device 6, the temperature in the non-sheet-passing region increases. The third thermistor 19*b* detects an inner surface temperature of a film portion corresponding to the non-sheet-passing region.

The control circuit portion 100 controls the shutter motor control circuit 400 (FIG. 9) when the third thermistor 19*b* detects a temperature not less than a predetermined threshold temperature. That is, the inner and outer shutter members 36(L, R) and 37(L, R) of the left and right shutter mechanisms 34(L, R) are moved by the shutter motor M2 to positions corresponding to the width of the small width sheets continuously passed through the fixing device 6. Further, the control circuit portion 100 controls a cooling fan driving circuit 500 (FIG. 9), so that an operation of the cooling fans 33(L1, L2, R1, R2) in the left and right ducts 32(L, R) is started.

As a result, the non-sheet-passing portions of the assembly 10 are cooled by the cooling air from the cooling fans, so that the non-sheet-passing region temperature rise of the fixing device 6 is suppressed.

Then, when a detection temperature of the third thermistor 19*b* is below the predetermined threshold temperature, the operation of the cooling fans 33(L1, L2, R1, R2) is stopped. A temperature range of ON-OFF control of the cooling fans depending on the detection temperature of the third thermistor 19*b* is controlled so as to be changed depending on a status of the operation of the cooling fans.

The temperature range of ON-OFF control of the cooling fans 33(L1, L2, R1, R2) in this embodiment is controlled in the following manner in the case where for example, B4-size sheets (short edge feeding; 257 mm×364 mm) are continuously passed through the fixing device 6.

That is, during sheet passing, when the detection temperature of the third thermistor 19*b* reaches 200° C. (operation start temperature), the operation of the cooling fans 33(L1, L2, R1, R2) is started. Then, the non-sheet-passing portions of the assembly 10 are cooled by the cooling air, and when the detection temperature of the third thermistor 19*b* decreases to 190° C. (operation stop temperature), the operation of the cooling fans is stopped.

(3) Shutter Member Opening and Closing Operation Constitution

Next, a shutter member opening and closing operation constitution which is a feature of this embodiment will be specifically described using FIG. 1 and FIGS. 15 to 19. A shutter member opening and closing operation of the left shutter mechanism 34L and a shutter member opening and closing operation of the right shutter mechanism 34R are similar to each other. However, operation directions of the left and right shutter mechanisms 34(L, R) are in a mutually opposite relationship. In the following, the shutter member opening and closing operation of the right shutter mechanism 34R will be specifically described as a representative.

First, an opening operation of the shutter members will be described.

Parts (a) and (b) of FIG. 15 are schematic views of the shutter mechanism 34R in a full-close state and during an open movement operation, respectively, as seen from the inlet port side (an inside of the shutter mechanism 34R).

Parts (a) and (b) of FIG. 16 are schematic views of the shutter mechanism 34R in the full-close state and during the open movement operation, respectively, as seen from the air blowing port side (an outside of the shutter mechanism 34R).

FIG. 17 is a schematic view showing a relationship among the inner shutter member 36R, the outer shutter member 37R and the duct 32R.

Parts (a) of FIG. 15 and part (a) of FIG. 16 show a full-close state of the shutter members of the shutter mechanism 34R. In this state, the air blowing port 31R of the duct 32R is closed over a full width by the inner shutter member 36R and the outer shutter member 37R which are moved to a full-close position (closed position).

That is, the air blowing port 31R and the window hole 38R opposing the air blowing port 31R are held in a non-communication state over a full width. The shutter mechanism 34R is in the full-close position in order to prevent failure (out of order) of the cooling fans 33(L1, L2, R1, R2) due to radiant heat from the film 13 in the case where cooling by the cooling fans 33(L1, L2, R1, R2) is not needed (for example, when the images are fixed on the maximum-width sheets).

Incidentally, in this embodiment, a constitution in which the air blowing port 31R is sufficiently closed at the full-close position was employed, but a state in which an open portion is slightly formed may also be used as the closed position. That is, a state in which the air blowing port 31R is most closed in a range in which the inner and outer shutter members 36R and 37R can be moved by control of the control circuit portion 100 is defined as the closed position.

In this full-close state of the shutter members, the shutter motor M2 is rotationally driven in CW (clockwise direction) (arrow D direction in FIGS. 15 and 16). Then, the driving pinion gear 41 engaging with the output gear MG of the shutter motor M2 is rotated in an arrow E direction (clockwise direction in FIG. 15). Then, the rack-shaped portion 42R engaging with the driving pinion gear 41 and formed in the inner shutter member 36R receives a force by rotation of the driving pinion gear 41.

As shown in FIG. 17, the guiding portion 47R formed on the inner shutter member 36R engages with the collar-shaped inner shutter member regulating portion 46R formed on the duct 32R along the longitudinal direction of the assembly 10. For that reason, the inner shutter member 36R moves in an assembly F direction toward a central side with respect to the longitudinal direction of the assembly 10 as shown in parts (b) of FIGS. 15 and 16.

The inner shutter member 36R includes a supporting portion 361R rotatably supporting the shutter pinion gear 35R, and the supporting portion 361R is also moved together with the inner shutter member 36R by movement of the inner shutter member 36R in the longitudinal direction of the assembly 10. The shutter pinion gear 35R engages with the rack-shaped portion 43R formed on the duct 32R.

The rack-shaped portion 43R is fixed to the duct 32R, and therefore, is not moved even when the inner shutter member 36R is moved in the longitudinal direction of the assembly 10. For that reason, the inner shutter member 36R is moved in the longitudinal direction of the assembly 10, so that the shutter pinion gear 35R rotates in an arrow G direction (counterclockwise direction in FIG. 15) as shown in FIG. 15. Then, a rack-shaped portion 44R of the outer shutter member 37R engages with the shutter pinion gear 35R.

For that reason, when the shutter pinion gear 35R rotates while moving together with the inner shutter member 36R, the rack-shaped portion 44R receives a force for moving the rack-shaped portion 44R in the longitudinal direction of the assembly 10, via the shutter pinion gear 35R. As a result, in interrelation with movement of the inner shutter member 36R in the longitudinal direction (F direction), the outer shutter member 37R also moves in the same direction (H direction).

The guiding portion 48R formed on the outer shutter member 37R engages with the collar-shaped outer shutter member regulating portion 49R formed on the inner shutter member 36R with respect to the longitudinal direction of the assembly 10. For that reason, the outer shutter member 37R moves in a direction (arrow H direction) toward a longitudinal center of the assembly 10 by an amount of movement by the rotation of the shutter pinion gear 35R in addition to a movement amount of the inner shutter member 36R, i.e., by a movement amount twice the movement amount of the inner shutter member 36R.

As a result, the outer shutter member 37R and the inner shutter member 36R are opened so that an overlapping region therebetween increases.

Here, in a shutter holding constituting in this embodiment, the guiding portion 47R provided on the inner shutter member 36R which is the second shutter member engages with the inner shutter member regulating portion 46R provided on the duct 32R. Further, the guiding portion 48R provided on the outer shutter member 37R which is the first shutter member engages with the outer shutter member regulating portion 49R provided on the inner shutter member 36R. Further, a constitution in which the first and second shutter members are held so that the first and second shutter members can perform translational motion by rotation of the shutter motor M2 was employed.

That is, a constitution in which the inner shutter member regulating portion 46R formed on the duct 32R is provided over a moving region of the inner shutter member 36R, while the outer shutter member regulating portion 49R formed on the inner shutter member 36R is provided over a moving region of the outer shutter member 37R was employed.

By employing such a constitution, in a region from the full-close position to the full-open position of the shutter members, delivery of the engaging portion of the outer shutter member from the duct to the inner shutter member does not occur. For that reason, even in the case where the inner shutter member and the outer shutter member are inclined due to an external force, such as the driving force or self weight, and play of the engaging portion, the delivery does not generate, and therefore, a stable operation can be performed with no catch over entirety of the shutter moving region.

Here, with respect to the longitudinal direction of the fixing film 13, a width of the air blowing port 31R which is not covered with the outer shutter member 37R and the inner shutter member 36R is referred to as an opening width.

Further, the inner shutter member 36R has a first surface for closing the air blowing port 31R at the closed position for closing the air blowing port 31R. The outer shutter member 37R has a second surface for closing the air blowing port 31R at the closed position for closing the air blowing port 31R. Each of the inner shutter member 36R and the outer shutter member 37R are movable so as to take the closed position, a first open position for changing the opening width of the air blowing port 31R to the first width, and a second open position for changing the opening width of the air blowing port 31R to the second width larger than the first width.

Further, the shutter members 36R and 37R move so that an overlapping area between the first surface and the second surface when the shutter members 36R and 37R are in the first open positions is larger than that when the shutter members 36R and 37R are in the second open positions.

The air blowing port 31R of the duct 32 is gradually opened from a longitudinal end portion side toward a longitudinal central portion side by an opening movement operation of the inner shutter member 36R and the outer shutter member 37R as described above. The air blowing port 31R and the window hole 38R communicate with each other correspondingly to the opening width.

Incidentally, the closing operation of the shutters is the reverse of the opening operation of the shutters, and therefore, will be omitted from detailed description.

Figure 1:
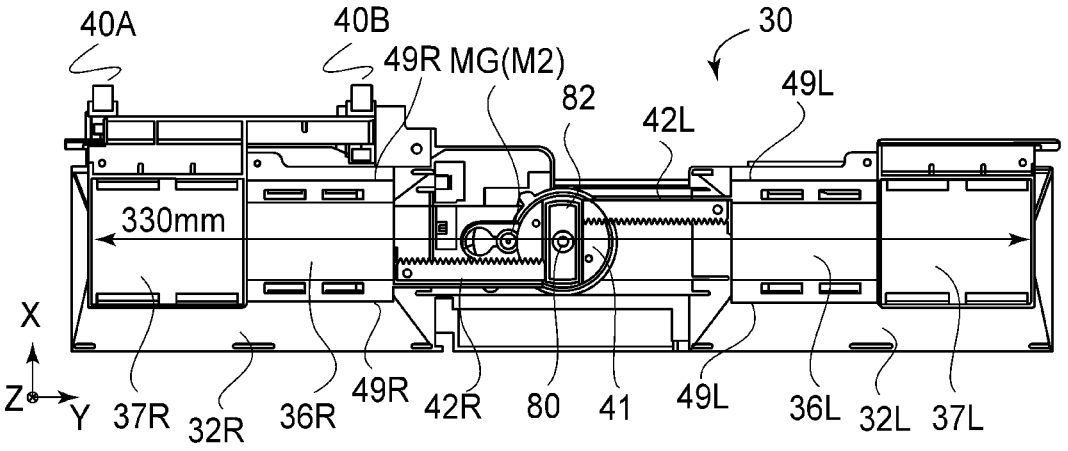
Figure 1:
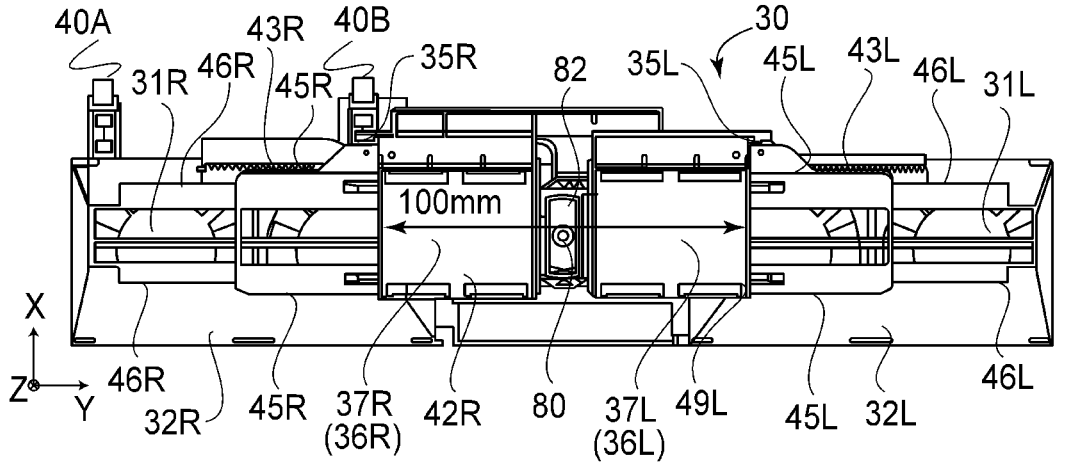

In this embodiment, in the shutter member full-close state of the left and right shutter mechanisms 34L and 34R, as shown in part (a) of FIG. 1, the shutter mechanisms 34L and 35R cover a range up to a width of 330 mm. In the shutter member full-close state, as shown in part (b) of FIG. 1, the shutter mechanisms 34L and 35R can open the left and right openings so that an interval therebetween is decreased to a width of 100 mm. Therefore, even in the case where sheets ranging from a widthwise size of 330 mm to a postcard width size of 100 mm are passed through the fixing device 6, a cooling range can be adjusted by appropriately adjusting shutter member positions.

Therefore, as in the air blowing cooling mechanism 30 in this embodiment, a constitution in which the plurality of shutter members of the left and right shutter mechanisms 34(L, R) movable depending on the width size of the sheet to be used are moved while overlapping with each other during the opening and closing operation thereof is employed. As a result, with the shutter member opening operation, a cooling regulation area by the shutter members reduces, and thus a maximum opening width of the shutter members can be enlarged, so that it becomes possible to enlarge a control width of the fixing member end portions in cooling ranges by the cooling fans. Therefore, even when the small-size sheets such as a postcard and an envelope are passed through the fixing device 6, the sheet passing can be carried out without lowering productivity.

The constitution of the above-described air blowing cooling mechanism 30 in this embodiment is summarized as follows. The air blowing cooling mechanism 30 is used in the fixing device (image heating apparatus) 6 including the film 13 as the rotatable heating member for heating the image on the sheet (recording material) at the nip N. The air blowing cooling mechanism 30 includes the duct 32 provided with the air blowing port 31 and includes the fan 33 for blowing the air toward the air blowing port 31 through the duct 32 in order to cool the predetermined region of the film 13.

Further, the air blowing cooling mechanism 30 includes the outer shutter member (first shutter member) 37 having the first surface for closing the air blowing port 31 at the close position where the air blowing port 31 is closed. Further, the air blowing cooling mechanism 30 includes the inner shutter member (second shutter member) 36 having the second surface for closing the air blowing port 31 at the closing position where the air blowing port 31 is closed. Further, the air blowing cooling mechanism 31 includes the driving member 41 for transmitting the drive (driving force) to the inner shutter member 36.

The inner shutter member 36 engages with the duct 32 so as to be movable in a translation motion direction by the drive of the driving member 41, and the outer shutter member 37 engages with the inner shutter member 36 so as to perform the translational motion operation in interrelation with the translational motion operation of the inner shutter member 36.

According to the air blowing cooling mechanism 30 having the above-described constitution, the range in which the rotatable heating member 13 can be cooled by the fan 33 can be improved. Further, even in the case where the opening of the shutter is increased for guiding and using the small-size recording material such as the postcard into the fixing device, the opening and closing operation of the shutter can be stably performed.

Further, in order to stably perform the shutter opening and closing operation, sliding resistances among the respective members may desirably be decreased since the inner shutter member and the outer shutter member which open and close the openings, and the duct move while overlapping with each other.

In this embodiment, the inner shutter member is formed in the shape described below, so that leakage of the air from the gap between the inner shutter member and the outer shutter member toward the sheet passing region is suppressed while decreasing the sliding resistance with the outer shutter member.

FIG. 18 shows a state (inner shutter member outer surface view) of the inner shutter member 36(L, R) as seen from the air blowing port side of the ducts and FIG. 19 shows a state (outer shutter member inner surface view) of the outer shutter members 37(L, R) as seen from the inlet port side of the ducts.

During opening and closing of the shutter members, back sides of the surfaces 52 of the outer shutter members 37(L, R) and the surfaces 50 of the inner shutter members 36(L, R) move while sliding with each other. Therefore, in order to reduce sliding friction, as shown in FIG. 18, regions 51 in which the inner shutter members 36(L, R) oppose the back sides of the surfaces 52 of the outer shutter members 37(L, R) are formed in a recessed shape relative to regions 60 so as to be spaced from the back sides of the surfaces 52 of the outer shutter members 37(L, R).

In this embodiment, a thickness of the regions 51 of the inner shutter members 36(L, R) is made thinner than thicknesses of the surfaces 50 on the duct air blowing port side and the region 60. As a result, the regions 51 are decreased in contact area with the back sides of the surfaces 52 of the outer shutter members 37(L, R), and therefore, the sliding friction can be reduced. On the other hand, the surfaces 50 and the region 60 slide with the back sides of the surfaces 52 of the outer shutter members 37(L, R).

The above is summarized as follows. A constitution in which in the case where the outer shutter member 37 and the inner shutter member 36 move while slide with each other, at least one shutter member 36 has the surface 51 made thinner than the sliding surface on the sliding surface side is employed.

Here, the contact portions (regions) 60 may preferably be provided continuously so as to cover the openings of the air blowing ports 31(L, R) with respect to the direction (X-axis direction in FIG. 22) perpendicular to the open-close direction of the inner shutter members 36(L, R). When the contact portions 60 are discontinuous in the direction perpendicular to the open-close direction of the inner shutter members 36(L, R), there is a liability that the air from the cooling fans 33(L1, L2, R1, R2) leaks toward the sheet passing region.

Further, in the closed positions, the contact portions 60 may preferably be provided in regions in which the contact portions 60 overlap with the outer shutter members 37(L, R), respectively. That is, as shown in FIG. 22, the contact portions 60 may preferably be provided at outside end portions of the inner shutter members 36(L, R) with respect to the film longitudinal direction. This is because the contact portions 60 can always contact the outer shutter members 37(L, R) with the opening and closing operation of the inner shutter members 36(L, R) and the outer shutter members 37(L, R).

Incidentally, not only the contact portions 60 but also the surfaces 50 are provided as slidable surfaces in a direction parallel to the opening and closing directions of the inner shutter members 36(L, R) and the outer shutter members 37(L, R). As a result, during the opening and closing operation, it is possible to suppress sliding of the regions 51 with the outer shutter members 37(L, R) caused by inclination of the inner shutter members 36(L, R).

Here, heights of the contact portions 60 and the surfaces 50 from the regions 51 are 0.5 mm or more.

Other Embodiments (1) In the above, the embodiments of the present invention were described, but numerical values of dimensions, conditions and the like mentioned in the above-described embodiments are examples, and therefore, the present invention is not limited thereto. The numerical values can be appropriately selected within a range to which the present invention is applicable. For example, fixing devices of a roller fixing type and an IH fixing type may also be used in combination with the air blowing cooling mechanisms as in the above-described embodiments.

(2) The film 13 in the fixing device 6 of the film heating type described in the above-mentioned embodiments is not limited to that having a constitution in which an inner surface thereof is supported by the heater 11 and the heat-insulating holder 12 and the film 13 is driven by the pressing roller 20. For example, the film 13 may also be of a unit type in which the film 13 is stretched and extended around a plurality of rollers and is driven by either one of these rollers.

(3) The pressing member 20 forming the nip N in cooperation with the film 13 is not limited to a roller member. For example, a pressing belt unit (which is also the fixing member) including a belt stretched and extended around a plurality of rollers may also be used.

(4) In this embodiment, feeding of the sheet P to the fixing device 6 is carried out by so-called center(-line) basis feeding with a sheet width center. That is, the sheet P is fed on the basis of a longitudinal center position of the assembly 10 in a sheet passing region. Also in the case where there is a sheet passing region based on a one-side end portion (edge) (i.e., in so-called one-side basis feeding in which feeding of the sheet is carried out on the basis of one-side end of the sheet), similarly as in the above-described embodiment, non-sheet-passing portion temperature rise occurs.

Also in this case, by disposing the air blowing cooling mechanism 30 similarly as in the above-described embodiment, the non-sheet-passing portion temperature rise can be suppressed. However, different from the above-described embodiment, the duct 32 is needed only on one side and therefore it is sufficient that the shutter mechanism 34 is disposed only on one side.

(5) As the fixing device 6, the device for fixing the unfixed toner image formed on the sheet by heating the toner image was described as an example, but the present invention is not limited thereto. For example, a device for increasing a gloss (glossiness) of an image by heating and re-fixing a toner image temporarily fixed on the recording paper (also in this case, the device is referred to as the fixing device) may also be used.

That is, for example, the fixing device 6 may also be a device for fixing the partly fixed toner image on the sheet or a device for subjecting the fixed image to a heating process. Accordingly, the fixing device 6 may also be, for example, a surface heating device (apparatus) for adjusting a gloss or a surface property of an image.

(6) The image forming apparatus described using the printer A as an example is not limited to the image forming apparatus for forming the monochromatic image but may also be an image forming apparatus for forming a color image. Further, the image forming apparatus can be carried out in various uses, such as a copying machine, a facsimile machine, and a multi-function machine having functions as these machines, by adding necessary device, equipment and casing structure.

(7) In the above description, for convenience, treatment of the recording material (sheet) P was described using terms associated with paper (sheet), such as sheet (paper) passing, sheet feeding, sheet discharge, sheet-passing-portion, non-sheet-passing-portion and the like, but the recording material is not limited to the paper. The recording material P is a sheet-shaped recording medium (media) on which the toner image is capable of being formed by the image forming apparatus. For example, regular or irregular recording media such as plain paper, thin paper, thick paper, high-quality paper, coated paper, envelope, postcard, seal, resin sheet, OHP sheet, printing sheet, formatted paper, and the like are cited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-088694 filed on May 2, 2018, which is hereby incorporated by reference herein in its entirety.

What is claimed is:

1. An air blowing cooling mechanism for cooling a rotatable heating member for heating an image on a recording material in a nip, said air blowing cooling mechanism comprising:

a duct provided with an air blowing port;

a fan configured to blow air toward said air blowing port through said duct to cool a predetermined region of the rotatable heating member;

a first shutter member movable so as to open and close said air blowing port;

a second shutter member movable so as to open and close said air blowing port in cooperation with said first shutter member, a part of said second shutter member overlapping with said first shutter member when said air blowing port is open;

a first gear configured to engage with said second shutter member and transmit a driving force to said second shutter member;

a second gear configured to transmit the driving force from said second shutter member to said first shutter member so that said first shutter member moves with movement of said second shutter member;

a first guide portion provided on said duct, said first guide portion being configured to engage with said second shutter member and guide the movement of said second shutter member when said second shutter member opens and closes said air blowing port; and a second guide portion provided on said second shutter member, said second guide portion being configured to engage with said first shutter member and guide the movement of said first shutter member when said first shutter member opens and closes said air blowing port, said second guide portion extending along a movement direction of said first shutter member to a position where said first shutter member engages with said second guide portion when said first shutter member is positioned at a position where said air blowing port is closed.

2. An air blowing cooling mechanism according to claim 1, wherein said first shutter member and said second shutter member are movable among a close position where said air blowing port is closed, a first open position where an opening width of said air blowing port is a first width, and a second open position where the opening width of said air blowing port is a second width lager than the first width, and wherein an area in which said first shutter member and said second shutter member overlap with each other when said first shutter member and said second shutter member are in the second position is larger than an area in which said first shutter member and said second shutter member overlap with each other when said first shutter member and said second shutter member are in the first position.

3. An air blowing cooling mechanism according to claim 2, further comprising detecting means configured to detect the first and second open positions of said first and second shutter members.

4. An air blowing cooling mechanism according to claim 1, wherein said fan is provided in said duct.

5. An air blowing cooling mechanism according to claim 1, further comprising a plurality of shutter assemblies including a first shutter assembly and a second shutter assembly, each shutter assembly of the plurality of shutter assemblies including said first shutter member, said second shutter member, and said second gear, wherein feeding of the recording material is center basis feeding, wherein said duct includes a first air blowing port and a second air blowing port, said first and second air blowing ports provided symmetrically with respect to a reference line of the center basis feeding, and wherein said first and second shutter assemblies are provided correspondingly to said first and second air blowing ports.

6. An image heating apparatus for heating an image on a recording material, said image heating apparatus comprising:

a rotatable heating member configured to heat the image on the recording material at a nip; and an air blowing cooling mechanism according to claim 1.

7. An image forming apparatus for forming an image on a recording material, said image forming apparatus comprising:

an image heating apparatus according to claim 6.

8. An image heating apparatus according to claim 6, wherein said air blowing port is provided on one end side of the duct opposite one end side of said rotatable heating member.

9. An image heating apparatus according to claim 6, further comprising a plurality of shutter assemblies including a first shutter assembly and a second shutter assembly, each shutter assembly of the plurality of shutter assemblies including said first shutter member, said second shutter member, and said second gear, wherein said duct includes a first air blowing port and a second air blowing port, said first air blowing port provided on a first end side of the duct opposite a first end side of said rotatable heating member, said second air blowing port provided on a second end side of the duct opposite a second end side of said rotatable heating member, and wherein said first and second shutter assemblies are provided correspondingly to said first and second air blowing ports.

10. An air blowing cooling mechanism according to claim 1, wherein said first shutter member and said second shutter member move same direction when said first shutter member and said second shutter member open and close said air blowing port.

11. An air blowing cooling mechanism according to claim 1, wherein said first shutter member and said second shutter member move along a rotational axis direction of the rotatable heating member when said first shutter member and said second shutter member open and close said air blowing port.

12. An air blowing cooling mechanism according to claim 1, wherein said second shutter member is located outside of said first shutter member with respect to the movement direction.

* * * * *